US010694810B2

(12) United States Patent
Davis et al.

(10) Patent No.: US 10,694,810 B2
(45) Date of Patent: Jun. 30, 2020

(54) ARTICLES OF FOOTWEAR COMPRISING A MIDSOLE WITH A WINDING AND METHODS OF MAKING THE SAME

(71) Applicant: Reebok International Limited, London (GB)

(72) Inventors: Paul Davis, Blackstone, MA (US); Frank Millette, Middleboro, MA (US); Henry L. Hardigan, III, Siler City, NC (US); Oleg Kamenetsky, Sharon, MA (US); Dennis Gaboriault, Millbury, MA (US)

(73) Assignee: Reebok International Limited, London (GB)

( * ) Notice: Subject to any disclaimer, the term of this patent is extended or adjusted under 35 U.S.C. 154(b) by 205 days.

(21) Appl. No.: 15/098,586

(22) Filed: Apr. 14, 2016

(65) Prior Publication Data

US 2017/0295886 A1 Oct. 19, 2017

(51) Int. Cl.

| | |
|---|---|
| ***A43B 13/12*** | (2006.01) |
| ***A43B 13/18*** | (2006.01) |
| ***A43B 13/20*** | (2006.01) |
| ***A43B 13/26*** | (2006.01) |
| ***A43D 5/00*** | (2006.01) |
| ***A43B 3/00*** | (2006.01) |

(52) U.S. Cl.

CPC ..... *A43B 13/125* (2013.01); *A43B 3/0042* (2013.01); *A43B 13/181* (2013.01); *A43B 13/184* (2013.01); *A43B 13/187* (2013.01); *A43B 13/206* (2013.01); *A43B 13/26* (2013.01); *A43D 5/00* (2013.01)

(58) Field of Classification Search

CPC ... A43B 13/125; A43B 13/127; A43B 13/184; A43B 13/186; A43B 13/20; A43B 13/206

USPC ..... 36/28, 29, 30 R, 35 B

See application file for complete search history.

(56) References Cited

U.S. PATENT DOCUMENTS

| | | | | |
|---|---|---|---|---|
| 2,468,886 A * | 5/1949 | Lutey | A43B 13/223 36/28 |
| 4,265,972 A * | 5/1981 | Rudner | A46D 1/00 264/45.5 |
| 4,536,974 A | 8/1985 | Cohen | |
| 4,593,482 A | 6/1986 | Mayer | |
| 4,864,738 A * | 9/1989 | Horovitz | A43B 13/20 2/413 |
| 4,952,450 A | 8/1990 | Noel | |
| 5,713,140 A | 2/1998 | Baggenstoss | |

(Continued)

FOREIGN PATENT DOCUMENTS

| | | |
|---|---|---|
| WO | WO 2009/057107 A2 | 5/2009 |
| WO | WO 2014/100462 A1 | 6/2014 |

*Primary Examiner* — Sharon M Prange

(74) *Attorney, Agent, or Firm* — Sterne, Kessler, Goldstein & Fox P.L.L.C.

(57) ABSTRACT

Articles of footwear including a midsole having a winding wrapped around at least a portion of the midsole. A midsole may include a core and a winding wrapped around the core to form a plurality of loops. Each loop of the winding may include a portion extending across a top surface of the core and a portion extending across a bottom surface of the core. The loops of the winding may protrude from the top surface of the core and/or the bottom surface of the core. Methods of making a midsole having a winding are also discussed.

23 Claims, 15 Drawing Sheets

(56) References Cited

U.S. PATENT DOCUMENTS

| | | | | |
|---|---|---|---|---|
| 5,987,780 | A * | 11/1999 | Lyden | A43B 13/20 36/153 |
| 6,763,611 | B1 * | 7/2004 | Fusco | A43B 13/125 36/25 R |
| 6,910,288 | B2 * | 6/2005 | Dua | A43B 1/04 12/146 C |
| 6,911,174 | B2 * | 6/2005 | Creagan | D01F 8/04 264/103 |
| 7,926,204 | B2 | 4/2011 | Ungari et al. | |
| 9,144,268 | B2 | 9/2015 | Swigart et al. | |
| 9,756,894 | B2 * | 9/2017 | McDowell | A43B 3/00 |
| 2006/0288612 | A1 | 12/2006 | Lucas et al. | |
| 2007/0170610 | A1 | 7/2007 | Payne et al. | |
| 2007/0266593 | A1 | 11/2007 | Schindler et al. | |
| 2008/0271339 | A1 | 11/2008 | Fischer | |
| 2008/0313928 | A1 * | 12/2008 | Adams | A43B 5/1633 36/103 |
| 2009/0094858 | A1 | 4/2009 | Ungari et al. | |
| 2009/0126225 | A1 | 5/2009 | Jarvis | |
| 2011/0016746 | A1 | 1/2011 | Callahan et al. | |
| 2011/0154584 | A1 | 6/2011 | Ungari et al. | |
| 2011/0232130 | A1 | 9/2011 | Boudreau et al. | |
| 2012/0102783 | A1 * | 5/2012 | Swigart | A43B 13/206 36/83 |
| 2013/0255103 | A1 * | 10/2013 | Dua | A43B 1/04 36/87 |
| 2014/0310986 | A1 * | 10/2014 | Tamm | A43B 1/00 36/84 |
| 2015/0250259 | A1 * | 9/2015 | Attey | A43B 3/108 36/103 |

* cited by examiner

ARTICLES OF FOOTWEAR COMPRISING A MIDSOLE WITH A WINDING AND METHODS OF MAKING THE SAME

BACKGROUND OF THE INVENTION

Field

The described embodiments generally relate to midsoles for articles of footwear. In particular, described embodiments relate to midsoles with a winding wrapped around at least a portion of the midsole.

Background

Individuals are often concerned with the amount of cushioning an article of footwear provides. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot. The sole of an article of footwear functions, in part, to provide cushioning to the wearer's foot and to protect it from these forces.

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during every day activity. Unless an individual is wearing shoes that provide proper cushioning and support, the soreness and fatigue associated with every day activity is more acute, and its onset may be accelerated. This discomfort for the wearer may diminish the incentive for further activity. Equally important, inadequately cushioned footwear can lead to injuries such as blisters; muscle, tendon, and ligament damage; and bone stress fractures. Improper footwear can also lead to other ailments, including back pain.

Proper footwear should be durable, comfortable, and provide other beneficial characteristics for an individual. Therefore, a continuing need exists for innovations in footwear.

BRIEF SUMMARY OF THE INVENTION

Some embodiments are directed towards an article of footwear including an upper and a midsole coupled to the upper, the midsole including a core having a top surface coupled to the upper and a bottom surface disposed opposite the top surface and a winding wrapped around the core to form a plurality of loops, each loop of the winding including a portion extending across and protruding from the top surface of the core and a portion extending across and protruding from the bottom surface of the core.

In some embodiments, the winding may be a single continuous piece wrapped to form the plurality of loops. In some embodiments, the winding may be a single continuous piece wrapped from a heel portion of the article of footwear to a midfoot portion of the article of footwear. In some embodiments, the winding may be a single continuous piece wrapped from a heel portion of the article of footwear to a forefoot portion of the article of footwear.

In some embodiments, the core may include a bladder. In some embodiments, the core may include a polymeric foam.

In some embodiments, the core may include one or more grooves formed in the top surface and the bottom surface of the core for receiving loops of the winding wrapped around the core.

In some embodiments, the article of footwear may include a footplate having recesses defined by a plurality of projections and each recess may be configured to receive the portion of a loop extending from the top surface of the core. In some embodiments, the height of the projections may be greater than the height of the loops extending from the top surface of the core. In some embodiments, the core may be coupled to the footplate.

In some embodiments, the core may include a forefoot core coupled to a rearfoot core. In some embodiments, the winding may be wrapped around the forefoot core at least twice and wrapped around the rearfoot core at least twice.

In some embodiments, the winding may be coupled to the top surface and the bottom surface of the core.

Some embodiments are directed towards a midsole for an article of footwear, the midsole including a core including a forefoot end disposed opposite a heel end in a longitudinal direction and a continuous circumferential groove formed in an exterior surface of the core, the continuous circumferential groove defining a plurality of adjacent recessed loops disposed along the core in the longitudinal direction, and a continuous elongate tube disposed in the plurality of adjacent recessed loops defined by the circumferential groove.

In some embodiments, the core may include a forefoot core coupled to a rearfoot core. In some embodiments, the core may include a plurality of continuous circumferential grooves defining a plurality of adjacent recessed loops and at least one continuous circumferential groove may be formed in an exterior surface of the forefoot core and at least one continuous circumferential groove may be formed in an exterior surface of the rearfoot core. In some embodiments, the core may include a plurality of continuous elongate tubes and at least one continuous elongate tube may be disposed in the circumferential groove formed in the forefoot core and at least one continuous elongate tube may be disposed in the circumferential groove formed in the rearfoot core.

Some embodiments are directed towards a method of making a midsole for an article of footwear, the method including forming a winding around a core to form a plurality of adjacent loops wrapped around the core, where each loop of the winding includes a portion extending across and protruding from a top surface of the core and a portion extending across and protruding from a bottom surface of the core.

In some embodiments, forming the winding may include extruding the winding and wrapping the winding around the core. In some embodiments, forming the winding may include extruding the winding onto the core to form a plurality of adjacent loops.

BRIEF DESCRIPTION OF THE DRAWINGS/FIGURES

DETAILED DESCRIPTION OF THE INVENTION

Figure 1:
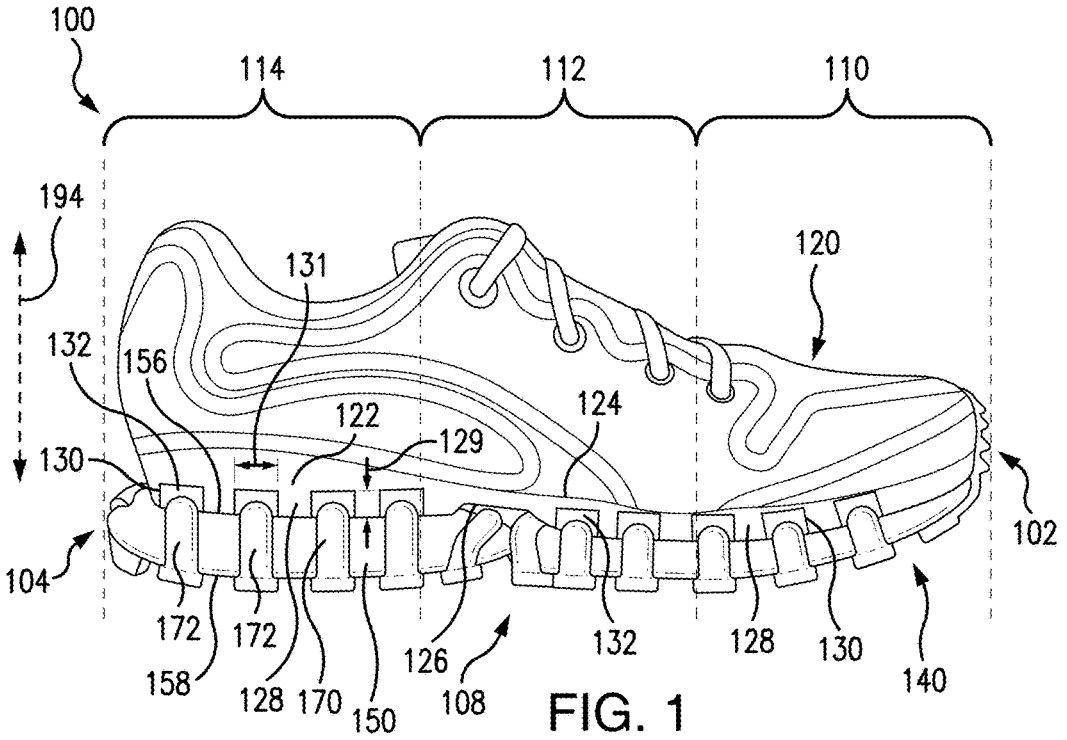
FIG. 1 is a side view of an article of footwear according to an embodiment.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

When an article of footwear contacts a surface, considerable forces may act on the article of footwear and, correspondingly, a wearer's foot. Cushioning provided by an article of footwear, and particularly the sole of the article of footwear, helps counteract these forces and may reduce potential discomfort for an individual. Discomfort experienced during an activity, for example, exercise, may diminish the incentive for further activity, which can be detrimental to an individual's wellbeing.

Some embodiments are directed towards an article of footwear including a midsole having a winding wrapped around a core. The core and the winding of the midsole may provide desired cushioning, support, and/or ride characteristics for the article of footwear. In some embodiments, the winding may be a continuous winding wrapped around a portion of the midsole. In some embodiments, the winding may include a plurality of loops, each loop being wrapped around the core of the midsole. In some embodiments, the winding may include a continuous winding wrapped around and extending from a heel portion of the midsole to a midfoot portion of the midsole. In some embodiments, the winding may include a continuous winding wrapped around and extending from a midfoot portion of the midsole to a forefoot portion of the midsole. In some embodiments, the winding may include a continuous winding wrapped around and extending from a heel portion of the midsole to a forefoot portion of the midsole. The characteristics of the winding (e.g., material composition, dimensions, and spacing between adjacent loops of the winding) may provide desired cushioning and ride characteristics for an article of footwear.

In some embodiments, a midsole may include a winding that is a continuous elongate tube wrapped around a core. In some embodiments, the elongate tube may be formed and then wrapped around a core. In some embodiments, the elongate tube may be formed directly around a core in a wrapped configuration. In some embodiments, the winding may be an extruded elongate tube. In some embodiments, the winding may be extruded directly onto and around a core. In some embodiments, the winding may be a molded elongate tube.

In some embodiments, a winding may be wrapped around at least a portion of a core such that it protrudes from one or more surfaces of the core. In some embodiments the core may be configured to deform around a winding to provide desired cushioning, support, and/or ride characteristics for a midsole, and therefore an article of footwear. In some embodiments, the core may be configured to deform between individual loops of a winding (e.g., like a balloon being squeezed between the fingers of an individual's hand). In such embodiments, the material composition and/or structural characteristics of the core may result in a core that is more flexible that the winding. In some embodiments, the core may be formed of an elastic material. In some embodiments, the spacing between different loops of a winding may influence the ability of a core to deform around winding (e.g., deform between loops of the winding), thereby influencing the cushioning, support, and/or ride characteristics of a midsole. In some embodiments, the spacing between different loops may be varied to provide desired cushioning, support and/or ride characteristics for different portions of a midsole (e.g., different amounts of cushioning in a heel portion and a forefoot portion of a midsole).

In some embodiments, when coupled to an upper, the winding of a midsole and/or the upper may be configured to produce an article of footwear having an upper that appears as if the upper is "floating" above the midsole. A "floating" upper may produce a desirable aesthetic appeal that catches a consumer's eye. A "floating" upper may also indicate to a consumer that a certain article of footwear is associated with a specific brand. In other words, a "floating" upper may spark brand recognition that attracts consumers.

Figure 2:
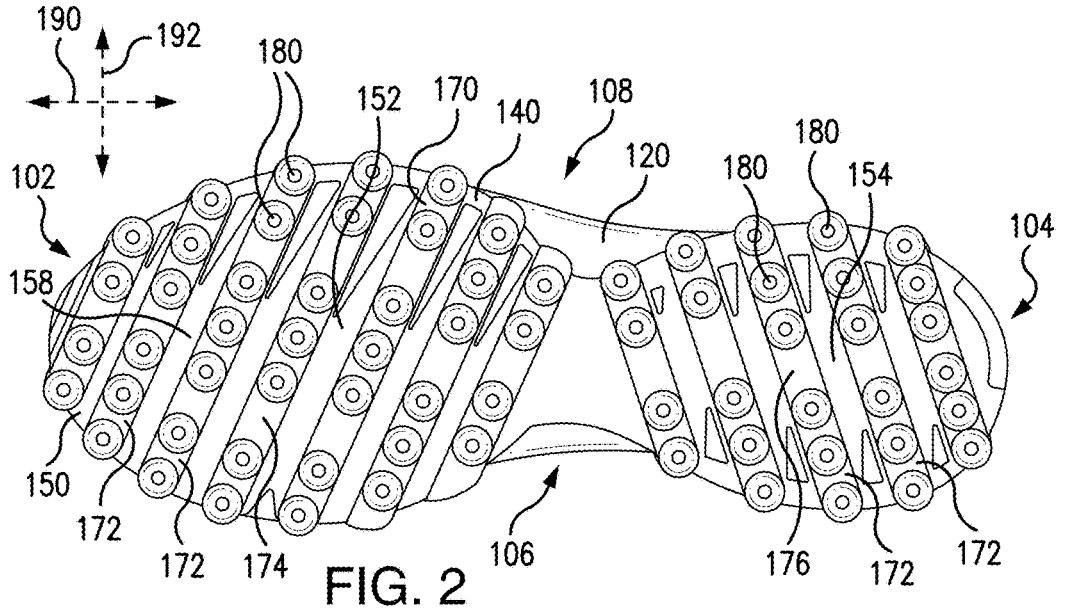
FIG. 2 is a bottom view of an article of footwear according to an embodiment.

FIGS. 1 and 2 show an article of footwear 100 according to an embodiment. Article of footwear 100 may include an upper 120 coupled to a midsole 140. Article of footwear 100 includes a forefoot end 102, a heel end 104, a medial side 106, and a lateral side 108 opposite medial side 106. Also as shown in FIG. 1, article of footwear 100 includes a forefoot portion 110, a midfoot portion 112, and a heel portion 114. Portions 110, 112, and 114 are not intended to demarcate precise areas of article of footwear 100. Rather, portions 110, 112, and 114 are intended to represent general areas of article of footwear 100 that provide a frame of reference. Although portions 110, 112, and 114 apply generally to article of footwear 100, references to portions 110, 112, and 114 also may apply specifically to upper 120 or midsole 140, or individual components of upper 120 or midsole 140. In some embodiments, article of footwear 100 may include an outsole coupled to midsole 140. In some embodiments, the outsole may be coupled to a winding 170 of midsole 140.

Midsole 140 may include a core 150 including a top surface 156 and a bottom surface 158 disposed opposite top surface 156 (e.g., in vertical direction 194). In some embodiments, core 150 may include a forefoot core 152 and a rearfoot core 154. In some embodiments, forefoot core 152 and rearfoot core 154 may be a single integrally formed piece. In some embodiments, forefoot core 152 and rearfoot core 154 may be separate pieces. In some embodiments, forefoot core 152 may be coupled to rearfoot core 154.

In some embodiments, core 150 may include a bladder, or a portion of core 150 (e.g., forefoot core 152 and/or rearfoot core 154) may include a bladder. In some embodiments, core 150 may include a bladder filled with air. In some embodiments, the air within the bladder may be at ambient air pressure (i.e., 1 atm (14.7 psi)). In some embodiments, the air within the bladder may be pressurized above ambient air pressure. In some embodiments, the air within the bladder may have a pressure in the range of 0.1 psi to 1.0 psi above ambient air pressure when no external forces are acting on the bladder. In some embodiments, the air within the bladder may have a pressure in the range of 0.2 psi to 0.5 psi above ambient air pressure when no external forces are acting on the bladder. In some embodiments, core 150, or a portion of core 150 (e.g., forefoot core 152 and/or rearfoot core 154) may comprise a solid piece of material (e.g., a polymeric foam).

Midsole 140 may include a winding 170 wrapped around at least a portion of core 150. As used herein, the term "wrapped" means a winding that is arranged about a core of a midsole in a wound configuration. A winding that is "wrapped" may be formed as a separate piece and then wound about a core of a midsole. For example, a "wrapped" winding may be extruded and then wound around a core. A winding that is "wrapped" may be formed directly around a core of a midsole. For example, a "wrapped" winding may be molded around an already formed core of a midsole, or may be integrally molded with a core of a midsole.

Winding 170 may be wrapped around a particular axis of core 150. In some embodiments, winding 170 may be wrapped around a central longitudinal axis of core 150 (i.e., the central axis of core 150 in longitudinal direction 190 between the forefoot end of core 150 and the heel end of core 150). In some embodiments, the central longitudinal axis of core 150 may be the central geometrical axis of core 150 in longitudinal direction 190. In some embodiments, winding 170 may be wrapped around a central transverse axis of core 150 (i.e., the central axis of core 150 in a transverse direction 192 between the medial side of core 150 and the lateral side of core 150). In some embodiments, the central transverse axis of core 150 may be the central geometrical axis of core 150 in transverse direction 192.

Winding 170 may include a plurality of loops 172 wrapped around core 150. As used herein, the term "loop" means a portion of a winding 170 that is wrapped approximately 360 degrees around an axis (e.g., a central longitudinal axis of a core 150). In some embodiments, a loop may be continuous segment wrapped approximately 360 degrees around an axis. In some embodiments, winding 170 may include one or more partial loops. In some embodiments, a loop may be partially discontinuous. For example, in some embodiments, a loop may not include a side portions wrapped around sidewalls of a core. As another example, in some embodiments, a loop may include discontinuous segments extending across the top or bottom of a core. In some embodiments, a loop may include a plurality of discontinuous segments arranged side-by-side in a wrapped configuration around core 150. In some embodiments, the discontinuous segments may include a shape such as, but not limited to, a cylindrical shape, a half-cylindrical shape, a spherical shape, or a hemispherical shape.

In some embodiments, winding 170 may include individual loops 172 disposed adjacent to each other on core 150. In some embodiments, individual loops 172 may be separate loops 172 not connected to each other. In some embodiments, winding 170 may be wrapped around core 150 in a continuous fashion to form a plurality of loops 172 with each loop 172 connected to its adjacent loop(s) 172. In some embodiments, the respective ends of a single loop 172 may be separated by a longitudinal distance measured in longitudinal direction 190. In such embodiments, loops 172 of winding 170 may be disposed in a spiral pattern around the axis about which loops 172 are wrapped (see e.g., FIG. 6). Loops 172 may have any 3-dimensional shape wrapped approximately 360 degrees around an axis.

In some embodiments, loops 172 may be wrapped around core 150 in longitudinal direction 190 between forefoot end 102 and heel end 104 of article of footwear 100. In other words, adjacent loops 172 may be arranged next to each other in longitudinal direction 190 between forefoot end 102 and heel end 104. In some embodiments, winding 170 may be a single continuous piece wrapped to form a plurality of loops 172 (e.g., a continuous elongate tube or rod). In some embodiments, winding 170 may be a continuous winding extending from forefoot end 102 to heel end 104. In some embodiments, winding 170 may be a single continuous piece wrapped from forefoot portion 110 (or heel portion 114) of article of footwear 100 to heel portion 114 (or forefoot portion 110) of article of footwear 100. In some embodiments, a continuous winding 170 may be wrapped around forefoot core 152 and rearfoot core 154. In some embodiments, midsole 140 may include a plurality of continuous windings 170 wrapped around core 150 and extending from forefoot end 102 to heel end 104 of article of footwear 100.

In some embodiments, winding 170 may be discontinuous (e.g., include multiple windings). In some embodiments, winding 170 may include a forefoot winding 174 wrapped around a forefoot portion of core 150 (e.g., forefoot core 152 as shown in FIG. 2). In some embodiments, forefoot winding 174 may be a single continuous piece wrapped from forefoot portion 110 of article of footwear 100 to midfoot portion 112 of article of footwear 100. In some embodiments, midsole 140 may include a plurality of continuous forefoot windings 174 wrapped around a forefoot portion of core 150. In some embodiments, winding 170 may include a rearfoot winding 176 wrapped around a rearfoot portion of core 150 (e.g., rearfoot core 154 as shown in FIG. 2). In some embodiments, rearfoot winding 176 may be a single continuous piece wrapped from heel portion 114 of article of footwear 100 to midfoot portion 112 of article of footwear 100. In some embodiments, midsole 140 may include a plurality of continuous rearfoot windings 176 wrapped around a rearfoot portion of core 150. Forefoot core 152 with forefoot winding 174 may be the same as or similar to midsole segment 400 or midsole segment 900 discussed herein. Similarly, rearfoot core 154 with rearfoot winding 176 may be the same as or similar to midsole segment 400 or midsole segment 900.

In some embodiments, winding 170 may be wrapped around core 150 to form a plurality of loops 172 with each loop 172 including a portion extending across top surface 156 of core 150. In some embodiments, all, or some of, loops 172 may include a portion extending across and protruding from top surface 156 of core 150. When midsole 140 is coupled to upper 120, loops 172 protruding from top surface 156 of core 150 may extend above top surface 156 towards upper 120. In some embodiments, winding 170 may be wrapped around core 150 to form a plurality of loops 172 with each loop 172 including a portion extending across bottom surface 158 of core 150. In some embodiments, all, or some of, loops 172 may include a portion extending across and protruding from bottom surface 158 of core 150. In some embodiments, winding 170 may be wrapped around core 150 to form a plurality of loops 172 with each loop 172 including a portion extending across and protruding from top surface 156 of core 150 and a portion extending across and protruding from bottom surface 158 of core 150.

Midsole 140 may be directly or indirectly coupled to upper 120 via, for example but not limited to, adhesive bonding, stitching, welding, or a combination thereof. In some embodiments, core 150 of midsole 140 may be directly coupled to upper 120. In some embodiments, top surface 156 of core 150 may be directly coupled to upper 120. In some embodiments, winding 170 of midsole 140 may alternatively or additionally be directly coupled to upper 120 (e.g., a portion of one or more loops 172 of winding 170 may be directly coupled to upper 120).

In some embodiments, article of footwear 100 may include a footplate 122. Footplate 122 may include a top surface 124 coupled to upper 120 and a bottom surface 126 disposed opposite top surface 124. Midsole 140 may be coupled to bottom surface 126 of footplate 122 via, for example, an adhesive (e.g., liquid cement). In some embodiments, core 150 of midsole 140 may be directly coupled to bottom surface 126 of footplate 122. In some embodiments, footplate 122 may be integrally formed with midsole 140. Footplate 122 may provide structural support for upper 120. Also, footplate 122 may facilitate coupling of upper 120 to midsole 140.

In some embodiments, footplate 122 may include recesses 130 defined by projections 128 on bottom surface 126 of footplate 122. Recesses 130 may be configured (i.e., sized and shaped) to receive all or a part of the portion of a loop 172 of winding 170 protruding from top surface 156 of core 150. In some embodiments, midsole 140 may be coupled to projections 128 of footplate 122. In some embodiments, core 150 of midsole 140 may be coupled to projections 128.

Figure 5:
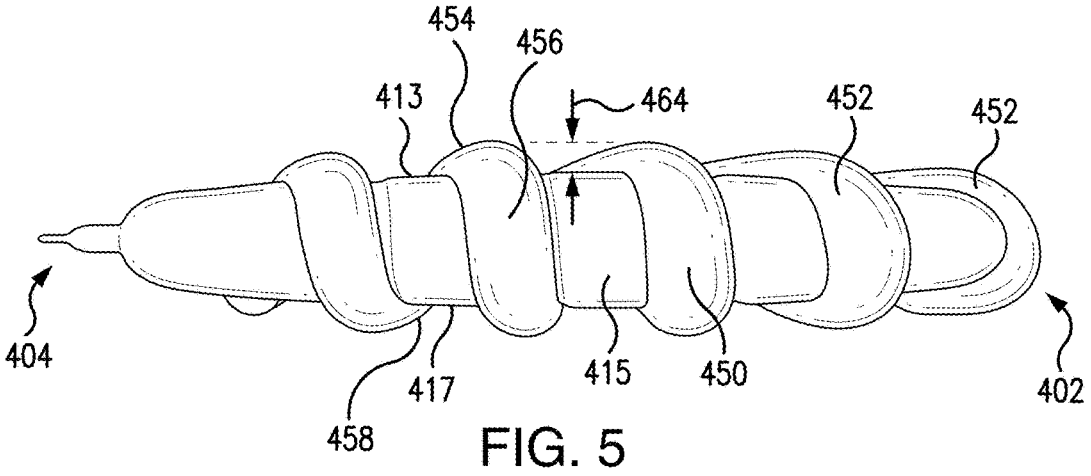
FIG. 5 is a side view of a portion of a midsole according to an embodiment.

In some embodiments, projections 128 may have a height 129 that is greater than the height of the portion of loop(s) 172 extending from a top surface 156 of a core 150 (e.g., greater than extension height 464 shown in FIG. 5). In some embodiments, projections 128 may be arranged such that the width 131 of recesses 130 is larger than the width of loops 172 of winding 170 (e.g., greater than width 463 shown in FIG. 7). The dimensions of projections 128 and recesses 130 may form gaps 132 located between loops 172 and projections 128/recesses 130. Gaps 132 may serve to give the visual impression that upper 120 is floating above midsole 140. In some embodiments, gaps 132 may serve to allow deformation of loops 172 within recesses 130 to facilitate desired cushioning, support, and/or ride characteristics for article of footwear 100. In some embodiments, the height 129 of projections 128 (i.e., the depth of recesses 130) may be less than the height of the portion of loop(s) 172 extending from a top surface 156 of a core 150. In such embodiments, a space may be created between footplate 122 and core 150 (see e.g., space 1490 in FIGS. 15A and 15B). This space may serve to give the visual impression that footplate 122 is floating above core 150 and may allow deformation of loops 172 between footplate 122 and core 150 to facilitate desired cushioning, support, and/or ride characteristics for an article of footwear.

In some embodiments, winding 170 may include traction disposed on a ground contact surface of winding 170. In some embodiments, as shown in FIG. 2, winding 170 may include a plurality of traction members 180 is disposed on the ground contacting surface of winding 170. In some embodiments, traction members may form all or a portion of an outsole for article of footwear 100.

Midsole 140 and portions thereof (e.g., core 150 and winding 170) may comprise material(s) for providing desired cushioning, ride, and/or support (e.g., stability). In some embodiments, core 150 and/or winding 170 may comprise one or more polymeric materials. Suitable materials for core 150 and winding 170 include, but are not limited to, a foam, a rubber, ethyl vinyl acetate (EVA), a thermoplastic polymer, such as expanded Thermoplastic polyurethane (eTPU), Thermoplastic rubber (TPR), a thermoplastic polyurethane (PU), or Peba (Pebax®), and silicone. In some embodiments, the foam may comprise a polymeric foam, for example, an EVA based foam or a PU based foam and the foam may be an open-cell foam or a closed-cell foam. In some embodiments, midsole 140 and portions thereof (e.g., core 150 and winding 170) may comprise elastomers, thermoplastic elastomers (TPE), foam-like plastics, or gel-like plastics.

In some embodiments, core 150 and winding 170 may comprise the same material. In some embodiments, core 150 and winding 170 may be formed of a different material, or of the same material but with different properties (e.g., different densities/hardness). In some embodiments, core 150 may be a single integrally formed piece. In some embodiments, winding 170 may be a single integrally formed piece. In some embodiments, core 150 and winding 170 may be a single integrally formed piece (formed of the same or different materials). In some embodiments, midsole 140 may comprise winding 170 without core 150. In such embodiments, winding 170 may have a wound configuration wrapped around a central axis and winding 170 may act alone as a midsole.

In some embodiments, portions of midsole 140 (e.g., core 150 and winding 170) may comprise different materials to provide different characteristics (e.g., cushion, support, and/or ride characteristics) to different portions of midsole 140. In some embodiments, core 150 and winding 170 may have different hardness and/or stiffness properties. As a non-limiting example, core 150 may be formed of a material having a lower stiffness than the material(s) forming winding 170. In some embodiments, the material density of core 150 and winding 170 may be different. In some embodiments, the moduli of the materials used to make core 150 and winding 170 may be different. As a non-limiting example, the material of core 150 may have a lower modulus than the material(s) of winding 170.

In some embodiments, midsole 140 may be configured to provide varying degrees of cushioning and/or support for different areas of a wearer's foot. In some embodiments, midsole 140 may include a winding 170 having loops 172 with varying dimensions and/or arrangements (e.g., varying diameters and/or varying spacing between adjacent loops 172) for providing varying degrees of cushioning and/or support. In some embodiments, midsole 140 may include a winding 170 having loops 172 with varying cross-sectional surface areas (e.g., varying diameters) for providing varying degrees of cushioning and/or support (see e.g., larger diameter winding disposed on a rearfoot portion of midsole 1400 compared to the smaller diameter winding disposed on a forefoot portion of midsole 1400 in FIG. 15B). In some embodiments, different loops 172 of winding 170 may be formed of a different material, or of the same material but with different properties (e.g., different density/hardness). In such embodiments, the material(s) used to make different loops 172 may provide desired amounts of cushioning, ride, and/or support for a wearer at different locations on article of footwear 100. In some embodiments, different portions of core 150 (e.g., forefoot core 152 and rearfoot core 154) may be formed of different materials, or of the same material but with different properties, to provide desired amounts of cushioning, ride, and/or support for a wearer at different locations on article of footwear 100.

In some embodiments, winding 170 may include a composite tube having different properties in different portions of midsole 140. For example, in some embodiments, winding 170 may include a composite winding having a higher density in heel portion 114 of midsole 140 to absorb impact to a wearer's heel. In some embodiments, a composite winding 170 may be a continuous winding formed of different materials along the length of winding 170. In some embodiments, a composite winding 170 may be formed of discrete segments made of different materials that are physically coupled together (e.g., via an adhesive and/or welding). In some embodiments, a composite winding 170 may be formed of discrete segments that are not coupled together. In some embodiments, the dimensions, arrangement, and material properties of different portions of winding 170 may work in concert with different portions of core 150 to provide varying degrees of cushioning, ride, and/or support for different areas of a wearer's foot.

In some embodiments, winding 170 may be a non-hollow tube. In some embodiments, winding 170 may be a co-axial composite tube. In some embodiments, the co-axial composite tube may include a central tube and one or more exterior shells (e.g., central tube 970 and exterior shell 972 shown in FIG. 13). In embodiments including multiple exterior shells, one or more of the exterior shells may comprise different materials. In some embodiments, the material properties of the central tube and the exterior shell(s) may be selected to produce desired cushioning, support, and/or ride characteristics for article of footwear 100. In some embodiments, the central tube and the exterior shell of winding 170 may be co-extruded. In some embodiments, the central tube may include a textile material. In some embodiments, winding 170 may be a hollow tube (e.g., one or more exterior shells without a central tube). In some embodiments, the hollow tube may be may filled with pressurized air. In some embodiments, the air pressure within the hollow tube may be in the range of 0.1 psi to 1.0 psi above ambient air pressure when no external forces are acting on winding 170.

In some embodiments, winding 170 may be an inflatable winding. In such embodiments, an air pump may be used to inflate a hollow interior of winding 170. In some embodiments, winding 170 may include valve mechanism(s) configured to allow inflation and/or deflation of winding 170 with an external pump. In some embodiments, article of footwear 100 may include an on-board pumping mechanism configured to inflate and/or deflate winding 170. In some embodiments, the on-board pumping mechanism may be the same as or similar to the inflation/deflation mechanisms discussed in U.S. application Ser. No. 11/610,382, filed Dec. 13, 2006, now U.S. Pat. No. 7,694,438, or U.S. application Ser. No. 10/186,717, filed on Jul. 2, 2002, now U.S. Pat. No. 6,785,985, the disclosures of which are hereby incorporated herein by reference in their entirety by reference thereto.

Figure 20:
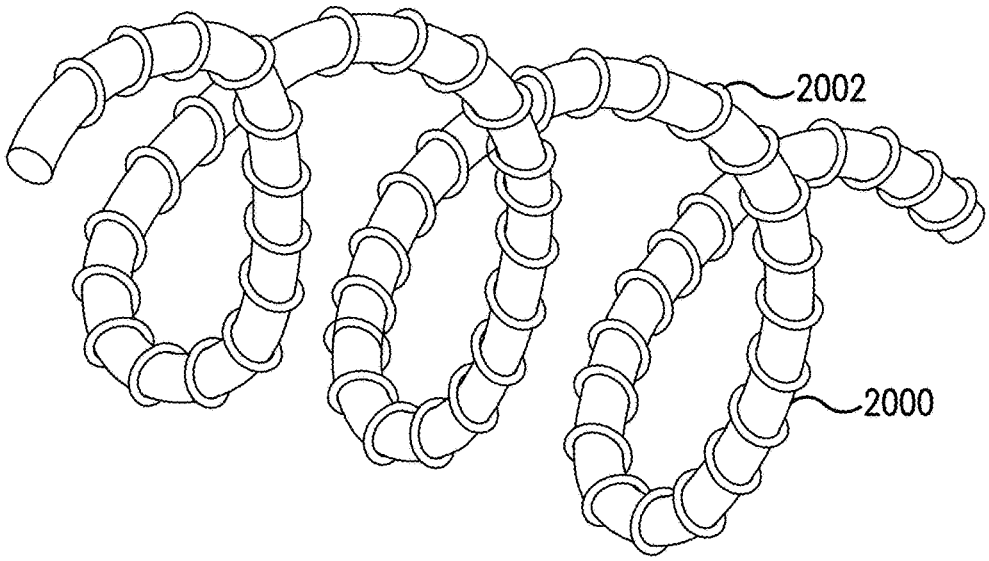
FIG. 20 is a perspective view of a winding according to an embodiment.

In some embodiments, winding 170 may include a coil wrapped around all or a portion of winding 170 (see e.g., winding 2000 including coil 2002 in FIG. 20). The coil may comprise one or more materials, such as the materials for winding 170 discussed herein. In some embodiments, the coil may comprise a rubber material. In some embodiments, the coil may be mechanically attached to winding 170 (e.g., via an adhesive or welding). In some embodiments, the coil may be integrally formed within winding 170. In embodiments including a coil wrapped around winding 170, the material properties of winding 170 and the coil may be selected to produce desired cushioning, support, and/or ride characteristics for article of footwear 100.

Figure 21A:
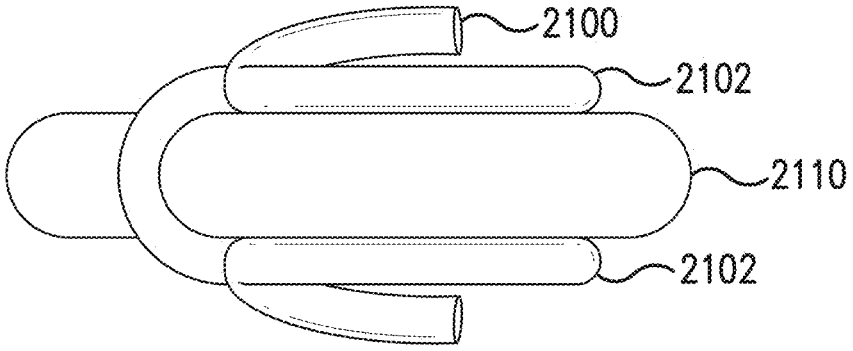
FIG. 21A is a side view of a winding and core according to an embodiment.
Figure 21B:
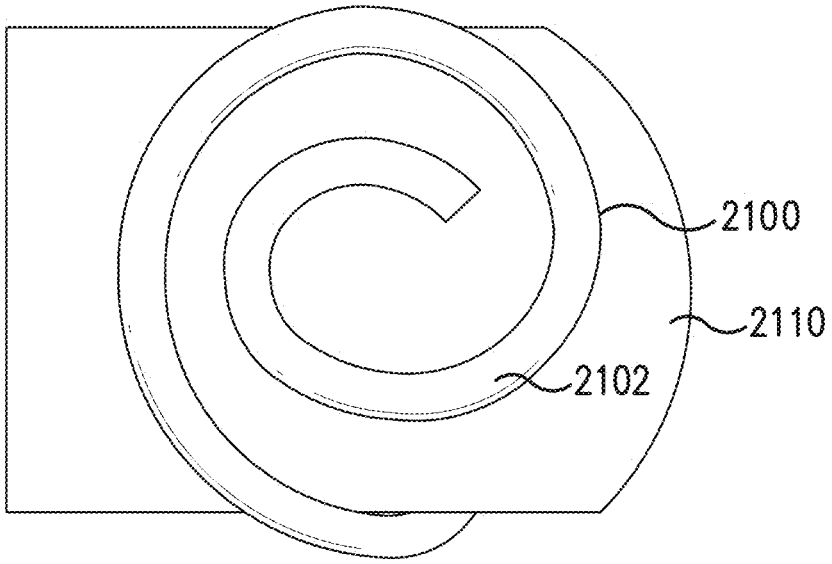
FIG. 21B is a top view of a winding and core according to an embodiment.

In some embodiments, winding 170 may include one or more spring windings (see e.g., winding 2100 in FIGS. 21A and 21B). Winding 2100 may include one or more spring coils 2102 located on one side of a core 2110 and one more spring coils 2102 located on the opposite side of core 2110. Core 2110 may be the same as or similar to cores 410 and 910 discussed herein. Winding 2100 may function like a spring to provide desired cushion, support, and/or ride characteristics for a midsole. In some embodiments, a midsole may include a forefoot spring winding disposed on a forefoot portion of the midsole and a rearfoot spring winding disposed on a rearfoot portion of the midsole (e.g., a forefoot spring winding disposed on forefoot core 152 and a rearfoot spring winding disposed on rearfoot core 154).

In some embodiments, the dimensions, arrangement, and/or material properties of winding 170 and/or core 150 may be based on a pressure map of pressures exerted on the bottom of a human foot. In such embodiments, an article of footwear may be customized to a particular individual's foot shape, pressure profile, and contour (i.e., foot anatomy). In some embodiments, the dimensions, arrangement, and/or material properties of winding 170 and/or core 150 may be based on a standard pressure map for an individual having certain characteristics, such as a particular shoe size (or shoe size range), height, weight, or combinations thereof. In some embodiments, dimensions, arrangement, and/or material properties of winding 170 and/or core 150 may be based on a pressure map of a specific individual's foot. Customizing the midsole of an article of footwear may provide proper cushioning and increased comfort for an individual. Also, it may allow an individual to order/buy articles of footwear customized to his or her needs. Moreover, since the pressure map for an individual may be saved, it may allow the individual to order/buy new and/or replacement articles of footwear customized to his or her needs when desired.

In some embodiments, pressure data for a pressure map may be collected using an in-shoe pressure measuring system, such as but not limited to, the PEDAR® system and related software (Novel Electronics, Munich, Germany). In some embodiments, the data collected may be used to calculate one or more values, such as but not limited to, the following: 1) peak pressures for different areas of the foot (measured in e.g., kilopascals (kPa)), 2) mean peak pressures representing the average of the peak pressures for an area of the foot during an activity (e.g., walking or running) or while standing still, 3) pressure-time integrals, which are the product of a mean peak pressure and the time over which it was applied, 4) peak forces for different areas of the foot (measured in e.g., % bodyweight (BW)), 5) mean peak forces representing the average of the peak forces for an area of the foot during an activity, and 6) force-time integrals, which are the product of a mean peak force and the time over which it was applied. Areas on the foot for which these values may be calculated include, but are not limited to, the area corresponding with the heel of the foot, each area corresponding to the anterior heads of each metatarsal of the foot, the area corresponding to the hallus (i.e., big toe) of the foot, the area corresponding to the lesser toes (i.e., four smaller toes) of the foot, the medial arch of the foot, the lateral arch of the foot, and the entire foot.

In some embodiments, the pressure map may be a standard pressure map based on one or more characteristics of an individual, such as but not limited to, foot or shoe size, foot anatomy (e.g., a high arched foot or a flat foot), weight, and height. In some embodiments, the pressure map may be a standard pressure map for a human foot (feet) having a particular shoe size. In some embodiments, the pressure map may be a standard pressure map for a human foot having a shoe size within a particular range. In some embodiments, the pressure map may be a pressure map for a specific individual.

In some embodiments, the pressure map may be a pressure map of a human foot measuring the pressures exerted on the bottom of the foot when standing upright. In some embodiments, the pressure map may be a composite pressure map of a human foot (feet) measuring pressures exerted on the bottom of the foot (feet) during a natural gait. In some embodiments, the pressure map may be a composite pressure map of a human foot (feet) measuring pressures exerted on the bottom of the foot (feet) during walking or running. In some embodiments, the pressure map may be a composite pressure map of a specific individual's foot (feet) measuring pressures exerted on the bottom of the specific individual's foot (feet) during his or her natural gait. In some embodiments, the pressure map may be a composite pressure map of a specific individual's foot (feet) measuring pressures exerted on the bottom of the specific individual's foot (feet) during walking or running.

A typical gait cycle for running or walking begins with a "heel strike" and ends with a "toe-off". During the gait cycle, the main distribution of forces on the foot begins adjacent to the lateral side of the heel (outside of the foot) during the "heel strike" phase of the gait, then moves toward the center axis of the foot in the arch area, and then moves to the medial side of the forefoot area (inside of the foot) during "toe-off". In some embodiments, obtaining a composite pressure map may include measuring pressure values at two or more selected times during a typical gait cycle. In some embodiments, obtaining a composite pressure map may include continuously measuring pressure values during a typical gait. In such embodiments, a pressure map may be used to create a midsole 140 tailored to provide optimal cushioning during an individual's natural gait (e.g., during walking or running).

Midsole 140 and portions thereof (e.g., core 150 and winding 170) may be formed using suitable techniques, including, but not limited to, injection molding, blow molding, compression molding, rotational molding, and wrapping. In some embodiments, winding 170 may be formed by extrusion. In some embodiments, core 150 and winding 170 may be discrete components that are formed separately and attached. In some embodiments, winding 170 may be attached to core 150 via, for example, but not limited to, adhesive bonding (e.g., using liquid cement), stitching, heat welding, or a combination thereof. In some embodiments, winding 170 may be coupled to core 150 via a mechanical interlock. For example, winding 170 may include one or more surface projections configured to engage corresponding recesses on core 150 (or vice versa). In some embodiments, winding 170 may be attached to core 150 via an adhesive disposed between winding 170 and core 150. In some embodiments, winding 170 may be in direct contact with top surface 124 and/or bottom surface 126 of core 150.

In some embodiments, winding 170 may be attached to core 150 such that relative movement between winding 170 and core 150 is prevented. In some embodiments, winding 170 may only be attached to core 150 at certain locations, or not attached to core 150 at all, so that winding 170 and core 150 may move relative to each other. In some embodiments, winding 170 may only be attached to the sidewall surfaces of core 150 to allow winding 170 to move relative to core 150. In some embodiments, midsole 140 may include connectors disposed between and coupling adjacent loops 172 together. In some embodiments, the connectors may reduce abrasion between winding 170 and core 150 by limiting the amount of relative movement between winding 170 and midsole core 150. In some embodiments, the connectors may be rubber connectors. In some embodiments, winding 170 may be extruded directly onto core 150 by wrapping an extruded winding around core 150. In some embodiments, the wrapping of an extruded winding may include multiple axis movement.

In some embodiments, when winding 170 and core 150 are assembled together, they may be fused together using, for example, a dip or spray coating technique to create a cohesive bond between winding 170 and core 150. This fusion may be accelerated with thermal sources such as convection or radiant heat, various wave frequency treatments such as microwave or radio-frequency (RF) treatments, and various light treatments such infrared (IR) and ultraviolet (UV) light treatments.

In some embodiments, winding 170 may be a porous material. In some embodiments, winding 170 may be a non-porous material. In some embodiment, winding 170 may comprise one or more polymeric materials. In some embodiments, winding 170 may be made of rubber, foam (e.g., dispensed urethane foam), silicone, plastic, thermoplastic (e.g., polyurethane, nylon, or polypropylene), a textile material (e.g., a knitted, woven, or non-woven material), or any other suitable material. In some embodiments, winding 170 may be a composite or blended material, for example, but not limited to, rubber and cork, rubber and thermoplastic resin, microspheres added to a resin, glass or carbon fibers added to a resin, and/or nanoparticles. In some embodiments, winding 170 may be an impregnated material. In some embodiments, winding 170 may have an exterior coating, for example, a sealant coating. Winding 170 may be a cured material, an uncured material, a reactive material, or a non-reactive material.

Various physical properties of core 150 and/or winding 170 may be varied to provide desired characteristics (e.g., ride and cushioning) for midsole 140, and therefore article of footwear 100. Physical properties of core 150 and winding 170 include, but are not limited to, thickness, color, density, material, shape, elasticity, etc. Winding 170 may include a cross-sectional shape such as, but not limited to, a circular shape, a semicircular shape, an elliptical shape, a semielliptical shape, and a polygonal shape (e.g., a square shape or a rectangular shape).

Upper 120 and midsole 140 may be configured for a specific type of footwear, including, but not limited to, a running shoe, a hiking shoe, a water shoe, a training shoe, a fitness shoe, a dancing shoe, a biking shoe, a tennis shoe, a cleat (e.g., a baseball cleat, a soccer cleat, or a football cleat), a basketball shoe, a boot, a walking shoe, a casual shoe, a sandal, or a dress shoe. Moreover, midsole 140 may be sized and shaped to provide a desired combination of cushioning, stability, and ride characteristics to article of footwear 100. Desired cushioning, ride, and stability may be provided at least in part by the configuration of winding 170 (e.g., size, shape, and arrangement of loops 172). The term "ride" may be used herein in describing some embodiments as an indication of the sense of smoothness or flow occurring during a gait cycle including heel strike, midfoot stance, toe off, and the transitions between these stages. In some embodiments, midsole 140 may provide particular ride features including, but not limited to, appropriate control of pronation and supination, support of natural movement, support of unconstrained or less constrained movement, appropriate management of rates of change and transition, and combinations thereof.

Upper 120 may be manufactured from leather, canvas, nylon, knitted fabric, molded fabric, combinations of these materials, or other suitable materials. In some embodiments, upper 120 may include a liner, waterproofing, or other accessories. In some embodiments, upper 120 may comprise a partial foot or full foot bootie. In this manner, upper 120 may be formed without seams.

Figure 3:
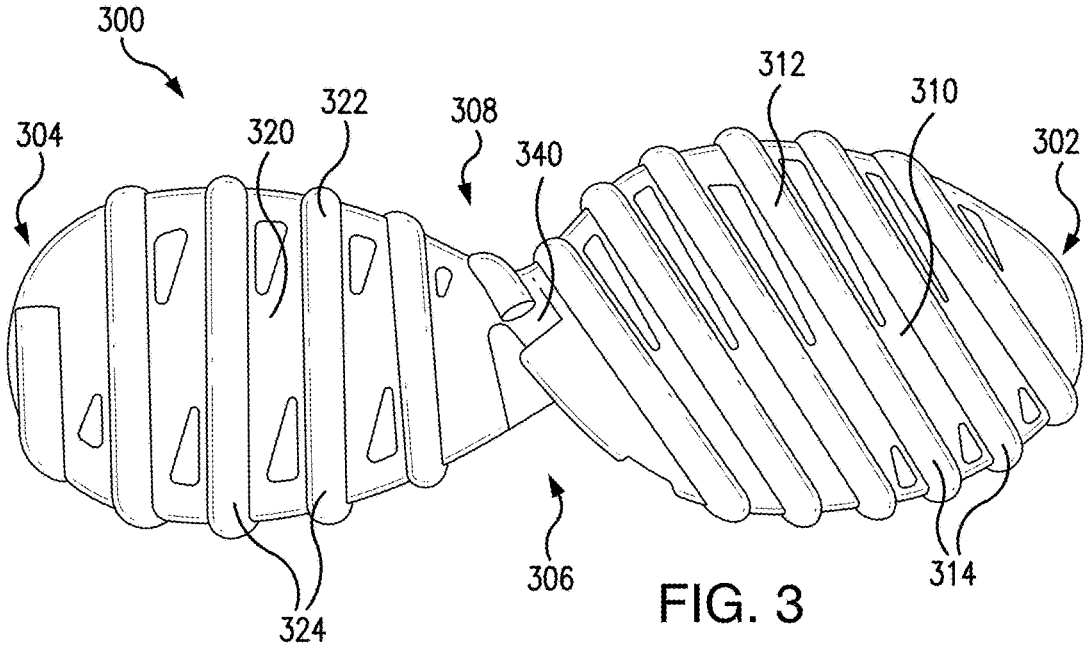
FIG. 3 is a midsole according to an embodiment.

FIG. 3 shows a midsole 300 according to an embodiment. Midsole 300 includes a forefoot end 302, a heel end 304, a medial side 306, and a lateral side 308 opposite medial side 306. Midsole 300 may include a forefoot core 310 coupled to a rearfoot core 320 by a connector 340.

Midsole 300 may include a forefoot winding 312 wrapped around forefoot core 310. In some embodiments, forefoot winding 312 may include a first end disposed at forefoot end 302 of midsole 300 and a second end disposed adjacent to connector 340. Forefoot winding 312 may be wrapped around forefoot core 310 at least twice to form a plurality of loops 314. In some embodiments, loops 314 may include portions arranged diagonally across forefoot core 310 between medial side 306 and lateral side 308. The characteristics of winding 312 and loops 314 may be the same as or similar to winding 170 and loops 172. Forefoot winding 312 may include a suitable number of loops 314 such as, but not limited to, three, four, five, or six loops.

Midsole 300 may include a rearfoot winding 322 wrapped around rearfoot core 320. In some embodiments, rearfoot winding 322 may include a first end disposed at heel end 304 of midsole 300 and a second end disposed adjacent to connector 340. Rearfoot winding 322 may be wrapped around rearfoot core 320 at least twice to form a plurality of loops 324. In some embodiments, loops 324 may include portions arranged straight across rearfoot core 320 between medial side 306 and lateral side 308.

In some embodiments, rearfoot winding 322 may be arranged in a different configuration than forefoot winding 312 (e.g., as shown in FIG. 3). In some embodiments, rearfoot winding 322 may be arranged in the same configuration as forefoot winding 312. The characteristics of rearfoot winding 322 and loops 324 may be the same as or similar to winding 170 and loops 172. Rearfoot winding 322 may include a suitable number of loops 324 such as, but not limited to, three, four, five, or six loops. In some embodiments, rearfoot winding 322 may include the same number of loops 324 as forefoot winding 312. In some embodiments, rearfoot winding 322 may include a different number of loops 324 than forefoot winding 312.

Figure 4:
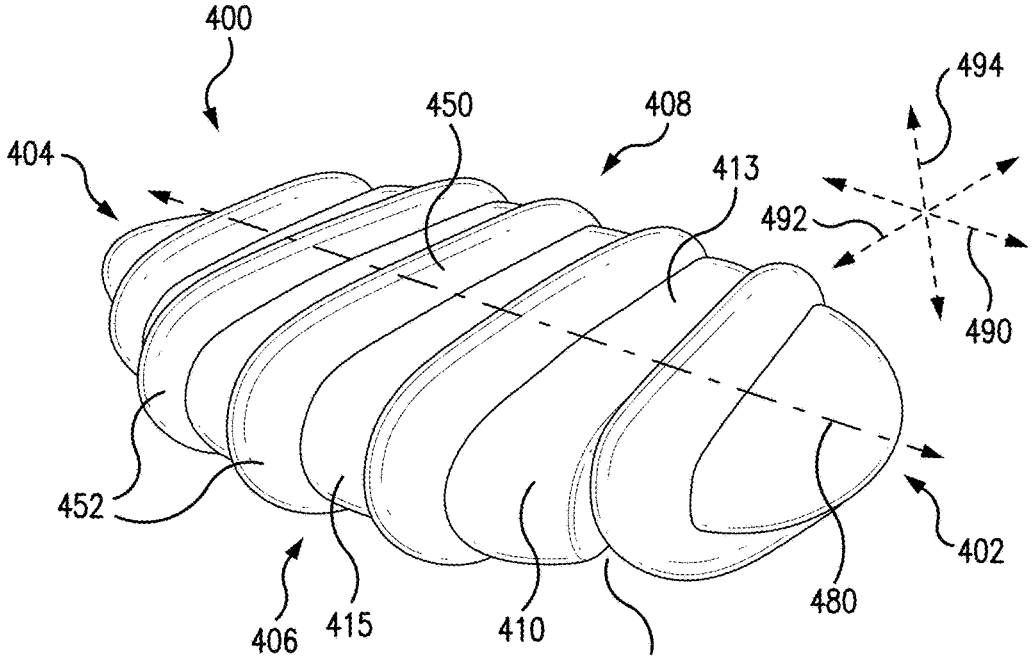
FIG. 4 is a perspective view of a portion of a midsole according to an embodiment.

FIG. 4 shows a midsole segment 400 according to an embodiment. Midsole segment may define a portion of a midsole (e.g., a forefoot portion of a midsole or a rearfoot portion of a midsole). Midsole segment 400 includes a forefoot end 402 disposed opposite a heel end 404 in a longitudinal direction 490 and a medial side 406 disposed opposite a lateral side 408 in a transverse direction 492.

Midsole segment 400 may include a core 410 having an exterior surface defined by a top surface 413, a bottom surface 417 disposed opposite top surface 413 in a vertical direction 494, and a sidewall surface (perimeter surface) 415 extending between top surface 413 and bottom surface 417. Midsole segment 400 may include a winding 450 wrapped around the exterior surface of core 410 multiple times to form a plurality of adjacent loops 452 disposed along core 410 in longitudinal direction 490. The characteristics of winding 450 and loops 452 may be the same as or similar to winding 170 and loops 172.

Loops 452 may comprise a top portion 454 extending across top surface 413 of core 410 from medial side 406 of core 410 to lateral side 408 of core 410 and a bottom portion 458 extending across bottom surface 417 of core 410 from medial side 406 of core 410 to lateral side 408 of core 410. Top portions 454 and bottom portions 458 of loops 452 may be connected by side portions 456 extending along sidewall surface 415. Top portions 454, side portions 456, and/or bottom portions 458 of loops 452 may be coupled to top surface 413, sidewall surface 415, and/or bottom surface 417 of core 410, respectively. Top portions 454, side portions 456, and/or bottom portions 458 of loops 452 may be coupled to top surface 413, sidewall surface 415, and/or bottom surface 417 via, for example, an adhesive (e.g., liquid cement), stitching, welding, or a combination thereof. In some embodiments, loops 452 may be coupled to core 410 via one or more mechanical interlocks. For example, loops 452 may include one or more surface projections configured to engage corresponding recesses on core 410 (or vice versa). In some embodiments, loops 452, or portions thereof, may be disposed in one or more grooves 420 formed in the exterior surface of core 410.

In some embodiments, one or more loops 452 may include a top portion 454 extending straight across top surface 413 of core 410 between medial side 406 and lateral side 408. In some embodiments, one or more loops 452 may include a bottom portion 458 extending straight across bottom surface 417 of core 410 between medial side 406 and lateral side 408. In some embodiments, straight portions of loops 452 extending across top surface 413 and/or bottom surface 417 may extended in a direction substantially perpendicular to longitudinal direction 490 (i.e., in a direction substantially parallel to transverse direction 492). In some embodiments, straight portions of loops 452 extending straight across top surface 413 and/or bottom surface 417 may extended in a diagonal direction relative to transverse direction 492. In some embodiments, side portions 456 may extend parallel to vertical direction 494. In some embodiments, side portions 456 may extend diagonally relative to vertical direction 494. In some embodiments, some or all loops 452 may have substantially the same shape. In some embodiments, different loops 452 may have different shapes.

Figure 7:
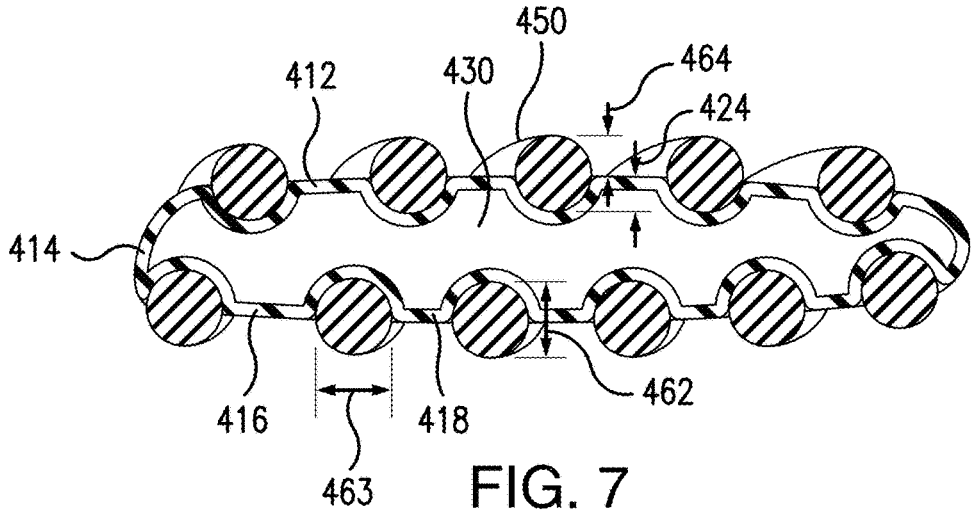
FIG. 7 is a cross-sectional view along the line 7-7' in FIG. 6.

In some embodiments, top portion 454 and/or bottom portion 458 of one or more loops 452 may protrude from top surface 413 and/or bottom surface 417, respectively, by an extension height 464 measured in vertical direction 494 (see e.g., FIGS. 5 and 7). In some embodiments, extension height 464 may be in the range of 0.5 millimeters to 10.0 millimeters. In some embodiments, extension height 464 may in the range of 1.0 millimeter to 5.0 millimeters. In some embodiments, side portions 456 of one or more loops 452 may protrude from sidewall surface 415 in transverse direction 492 in by a distance that is more than, less than, or the same as extension height 464.

The protrusion of one or more portions of loops 452 from the surface(s) of core 410 may allow winding 450 to deform relative to core 410 (e.g., relative to top surface 413, bottom surface 417, and/or sidewall surface 415 of core 410) when pressure is applied to midsole segment 400 (e.g., when midsole segment 400 is deformed under the weight of an individual). The deformation of loops 452 may provide desired cushion, support, and/or ride characteristics for midsole segment 400. In some embodiments, the protrusion of one or more portions of loops 452 from the surface(s) of core 410 may allow core 410 to deform around loops 452 (e.g., in between loops 452) when pressure is applied to midsole segment 400 (e.g., when midsole segment is deformed under the weight of an individual). The deformation of core 410 around loops 452 may provide desired cushion, support, and/or ride characteristics for midsole segment 400.

Figure 6:
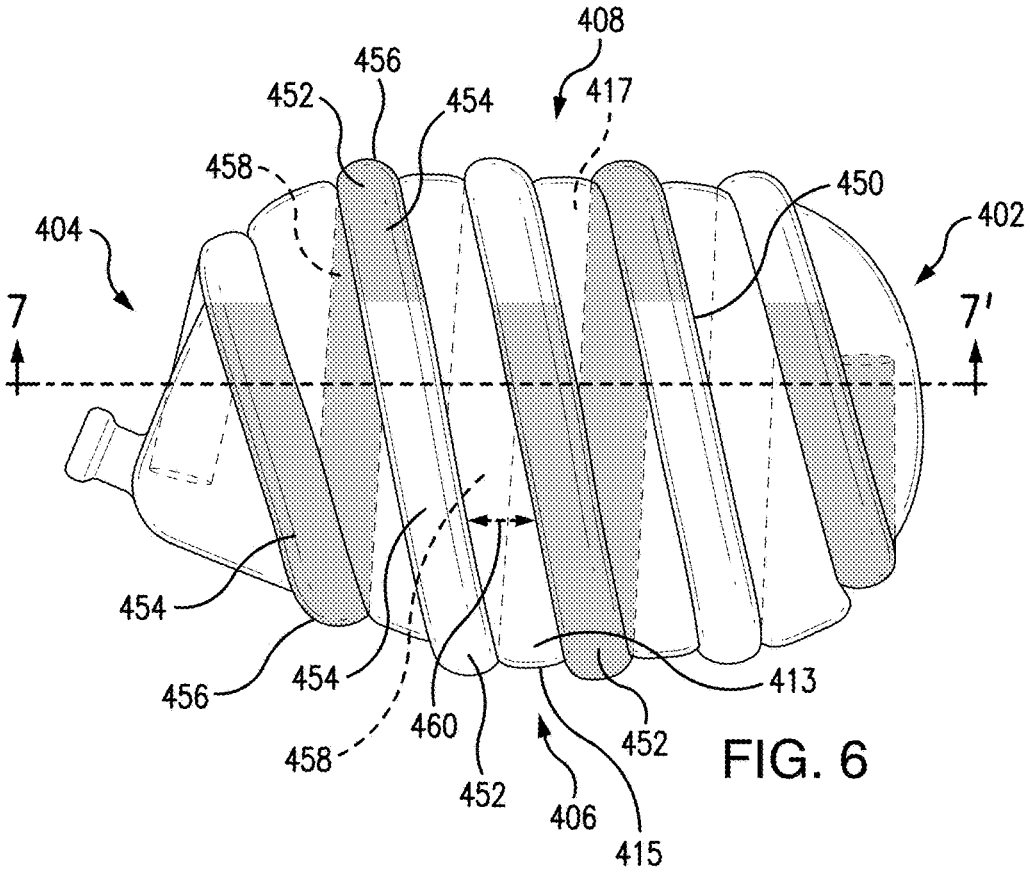
FIG. 6 is a top view of a portion of a midsole according to an embodiment.

FIG. 6 shows winding 450 including a plurality of loops 452 wrapped around core 410 according to an embodiment. For illustration, every other loop 452 (or partial loop) is shaded gray in FIG. 6. While loops 452 have been demarcated at certain locations in FIG. 6, the demarcation of loops 452 is only for illustration purposes. As shown in FIG. 6, loops 452 include a top portion 454 extending across top surface 413 of core 410, a bottom portion 458 (shown in broken lines) extending across bottom surface 417 of core 410, and opposing side portions 456 extending along sidewall surface 415. As shown in FIG. 6, adjacent loops 452 may be separated by a longitudinal distance 460 measured in longitudinal direction 490. Longitudinal distance 460 between adjacent loops 452 may define a number of loops per unit distance in longitudinal direction 490.

In some embodiments, the longitudinal distance 460 between each set of adjacent loops 452 may be the same (i.e., the number of loops per unit distance may be substantially the same along the length of a midsole in longitudinal direction 490). In some embodiments, the longitudinal distance 460 between different sets of adjacent loops may be different (i.e., the number of loops per unit distance may vary along the length of a midsole in longitudinal direction 490). Changing the longitudinal distance 460 between adjacent loops 452 in longitudinal direction 490 may provide desired cushion, support, and/or ride characteristics for different areas of a midsole. For example, in some embodiments, the number of loops per unit distance in a heel portion of a midsole may be smaller than the number of loops per unit distance in a forefoot portion of the midsole (see e.g., FIG. 3). As another example, the number of loops per unit distance in a heel portion of a midsole may be smaller than the number of loops per unit distance in a midfoot portion of the midsole (see also, e.g., FIG. 3). In some embodiments, the number of loops per unit distance in longitudinal direction 490 may be based on a pressure map of pressures exerted on the bottom of a human foot in contact with the ground.

In some embodiments, longitudinal distance 460 between adjacent loops 452 may remain constant in transverse direction 492 between medial side 406 and lateral side 408 of a midsole (see e.g., FIG. 6). In some embodiments, longitudinal distance 460 between adjacent loops 452 may vary in transverse direction 492. Varying longitudinal distance 460 in transverse direction 492 may provide desired cushion, support, and/or ride characteristics for different areas of a midsole. In some embodiments, a variation in longitudinal distance 460 between adjacent loops 452 in transverse direction 492 may be based on a pressure map of pressures exerted on the bottom of a human foot in contact with the ground.

In some embodiments, winding 450 may be wrapped around a central longitudinal axis 480 of core 410 (see e.g., FIG. 4). In some embodiments, central longitudinal axis 480 may be the geometrical center axis of core 410 in longitudinal direction 490. In some embodiments, as shown for example in FIG. 6, adjacent loops 452 of winding 450 may partially overlap in longitudinal direction 490. In some embodiments, adjacent loops 452 of winding 450 may not overlap in longitudinal direction 490. In some embodiments, winding 450 may be wrapped around a central transverse axis of core 410 (e.g., the geometrical central axis of core 410 in transverse direction 492). In such embodiments, the transverse distance between adjacent loops may be used to provide desired cushion, support, and/or ride characteristics for different areas of a midsole in the same fashion as described for longitudinal distance 460.

FIG. 7 shows a cross-sectional view of midsole segment 400 along the line 7-7' in FIG. 6. As shown in FIG. 7, core 410 may include a bladder 418 having a hollow interior 430 defined by a top wall 412, a bottom wall 416, and sidewall (perimeter wall) 414 extending between top wall 412 and bottom wall 416. In such embodiments, top wall 412, bottom wall 416, and sidewall 414 define top surface 413, bottom surface 417, and sidewall surface 415, respectively. In some embodiments, hollow interior 430 may include air that is pressurized relative to ambient air pressure. In some embodiments, the pressure within hollow interior 430 may be in the range of 0.1 psi to 1.0 psi above ambient air pressure when no external forces are acting on bladder 418. In some embodiments, the pressure within hollow interior 430 may be in the range of 0.2 psi to 0.5 psi above ambient air pressure when no external forces are acting on bladder 418. In some embodiments, the air pressure within bladder 418 may be tailed to provide desired cushion, support, and/or ride characteristics of midsole segment 400. In some embodiments, winding 450 may provide structural support for bladder 418 so that bladder 418 may be formed with thinner walls for a given air pressure within bladder 418. In some embodiments, core 410 may be a solid piece of material (e.g., non-hollow), like core 910 discussed in reference to FIGS. 9-13.

In some embodiments, winding 450 may include a circular cross-sectional shape. In some embodiments, the height 462 of winding 450 measured in vertical direction 494 may be in the range of 1.0 millimeter to 15.0 millimeters. In some embodiments, the height 462 of winding 450 measured in vertical direction 494 may be in the range of 2.5 millimeters to 7.5 millimeters. In some embodiments, height 462 may be approximately 5.0 millimeters. In some embodiments, including embodiments with a winding 450 having a circular cross-section, the width 463 of winding measured in longitudinal direction 490 will be the same as height 462. In some embodiments, winding 450 may include a non-circular cross-sectional shape. Non-circular cross-sectional shapes include, but are not limited to, an elliptical shape, a triangular shape, a square shape, a pentagon shape, a hexagon shape, or an octagon shape. In some embodiments, winding 450 may have a cross-sectional shape that is half any of the preceding shapes (i.e., a semicircular shape, a semielliptical shape, etc.). In some embodiments, height 462 may be different than width 463. In some embodiments, width 463 may be in the range of 1.0 millimeters to 15.0 millimeters. In some embodiments, width 463 may be in the range of 2.5 millimeters to 7.5 millimeters. In some embodiments, width 463 may be approximately 5.0 millimeters. The height 462 and/or width 463 of winding 450 may be tailored to provide desired cushion, support, and/or ride characteristics for midsole segment 400. In some embodiments, height 462 and/or width 463 of winding 450 may be constant along core 410. In some embodiments, height 462 and/or width 463 may vary at different portions of core 410. For example, height 462 and/or width 463 of winding 450 may vary along core 410 in longitudinal direction 490. In such embodiments, height 462 and/or width 463 may provide desired cushion, support, and/or ride characteristics for different areas of midsole segment 400.

Figure 8:
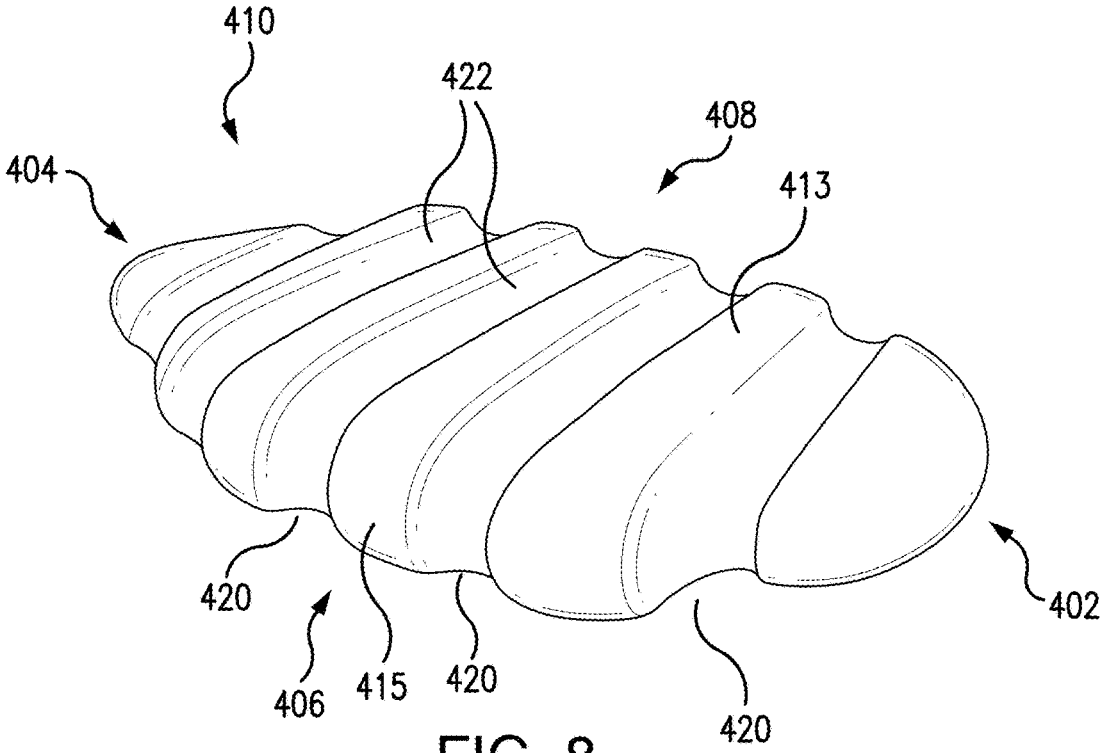
FIG. 8 is a perspective view of a core for a midsole according to an embodiment.
Figure 9:
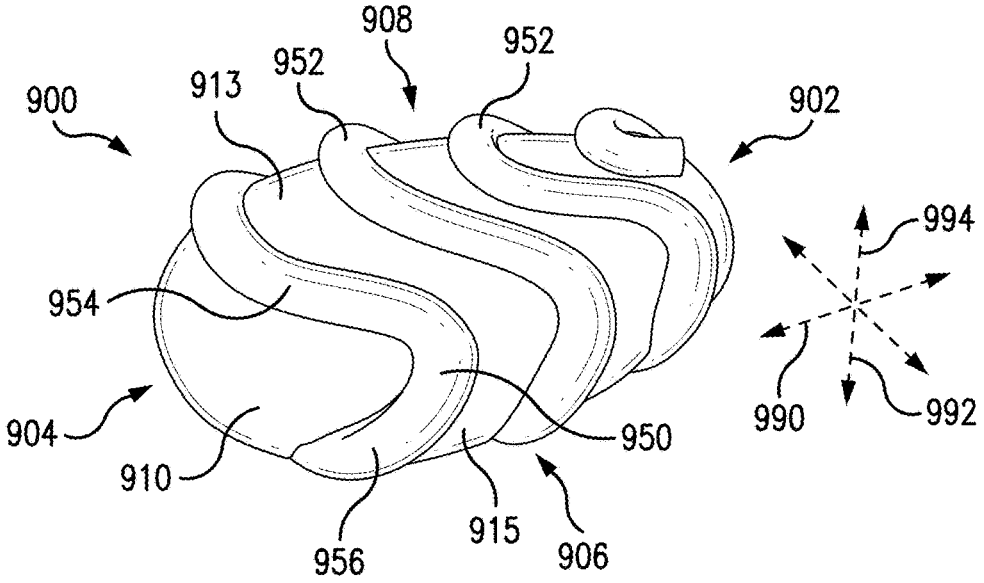
FIG. 9 is a perspective of a portion of a midsole according to an embodiment.

In some embodiments, winding 450 (or one or more loops 452 of winding 450) may be disposed in one or more grooves 420 on core 410. FIG. 8 shows core 410 with a groove 420 formed in the exterior surface of core 410 (i.e., formed in top surface 413, sidewall surface 415, and/or bottom surface 417). In some embodiments, groove 420 may be a continuous circumferential groove formed in top surface 413, sidewall surface 415, and bottom surface 417 of core 410. Groove 420 may define a plurality of adjacent recessed loops 422 disposed along core in longitudinal direction 490. Adjacent loops 452 of winding 450 may be disposed in adjacent recessed loops 422 defined by groove 420.

In some embodiments, one or more loops 452 of winding 450 may be partially disposed within recessed loops 422 of groove 420. In some embodiments, one or more loops 452 of winding 450 may be fully disposed within recessed loops 422 of groove 420 (i.e., may not protrude above top surface 413 and/or below bottom surface 417 of core 410). In some embodiments, top portions 454, side portions 456, and/or bottom portions 458 of loops 452 may be coupled to top surface 413, sidewall surface 415, and/or bottom surface 417 within groove 420. In some embodiments, groove 420 may include a cross-sectional shape that conforms with the exterior shape of winding 450. In some embodiments, groove 420 may include a semi-circular cross-sectional shape. In some embodiments, groove 420 may have a depth 424 in the range of 1.0 millimeter to 10.0 millimeters. In some embodiments, groove 420 may have a depth 424 in the range of 1.25 millimeters to 3.75 millimeters. In some embodiments, groove 420 may have a depth 424 that is equal to approximately half of height 462 of winding 450. In some embodiments, depth 424 of groove 420 may be constant along core 410. In some embodiments, depth 424 of groove 420 may vary at different portions of core 410. For example, depth 424 of groove 420 may be different on top surface 413 and bottom surface 417. As other example, depth 424 of groove 420 may vary along core 410 in longitudinal direction 490. In such embodiments, depth 424 may provide desired cushion, support, and/or ride characteristics for different areas of midsole segment 400 by influencing the extension height 464 of winding 450 at different areas of midsole segment 400.

In some embodiments, a core (e.g., core 150) may include a plurality of continuous circumferential grooves 420 defining a plurality of adjacent recessed loops 422. In some embodiments, at least one continuous circumferential groove 420 may be formed in an exterior surface of a core of a first midsole segment (e.g., forefoot core 152) and at least one continuous circumferential groove 420 may be formed in an exterior surface of a second midsole segment (e.g., rearfoot core 154). In some embodiments, a core (e.g., core 150) may include a plurality of continuous elongate tubes (e.g., windings 170), where at least one continuous elongate tube is disposed in a circumferential groove 420 formed a first midsole segment (e.g., forefoot core 152) and where at least one continuous elongate tube is disposed in a circumferential groove formed in a second midsole segment (e.g., rearfoot core 154).

FIGS. 9-13 show a midsole segment 900 according to an embodiment. Similar to midsole segment 400, midsole segment 900 may define a portion of a midsole (e.g., a forefoot portion of a midsole or a rearfoot portion of a midsole). Midsole segment 900 includes a forefoot end 902 disposed opposite a heel end 904 in a longitudinal direction 990 and a medial side 906 disposed opposite a lateral side 908 in a transverse direction 992.

Midsole segment 900 may include a core 910 having an exterior surface defined by a top surface 913, a bottom surface 917 disposed opposite top surface 913 in a vertical direction 994, and a sidewall surface (perimeter surface) 915 extending between top surface 913 and bottom surface 917. Midsole segment 900 may include a winding 950 wrapped around the exterior surface of core 910 multiple times to form a plurality of adjacent loops 952 disposed along core 910 in longitudinal direction 990. The characteristics of winding 950 and loops 952 may be the same as or similar to winding 170 and loops 172.

Similar to loops 452, loops 952 may comprise a top portion 954 extending across top surface 913 of core 910 from medial side 906 of core 910 to lateral side 908 of core 910 and a bottom portion 958 extending across bottom surface 917 of core 910 from medial side 906 of core 910 to lateral side 908 of core 910. Top portions 954 and bottom portions 958 of loops 952 may be connected by side portions 956 extending along sidewall surface 915. Top portions 954, side portions 956, and/or bottom portions 958 of loops 952 may be coupled to top surface 913, sidewall surface 915, and/or bottom surface 917 of core 910, respectively, via, for example, an adhesive, stitching, welding, or a combination thereof. In some embodiments, loops 952 may be coupled to core 910 via one or more mechanical interlocks. For example, loops 952 may include one or more surface projections configured to engage corresponding recesses on core 910 (or vice versa). In some embodiments, loops 952, or portions thereof, may be disposed in grooves 920 formed in core 910.

In some embodiments, one or more loops 952 may include a top portion 954 extending across top surface 913 of core 910 in a wavy configuration between medial side 906 and lateral side 908 of core 910. In some embodiments, one or more loops 952 may include a bottom portion 958 extending across bottom surface 917 of core 910 in a wavy configuration between medial side 906 and lateral side 908 of core 910. Wavy portions of loops 952 change direction when moving from medial side 906 to lateral side 908 of core 910 (e.g., change direction relative to longitudinal direction 490 when moving from medial side 906 to lateral side 908 of core 910). In some embodiments, side portions 956 may extend parallel to vertical direction 994. In some embodiments, side portions 956 may extend diagonally relative to vertical direction 994. In some embodiments, some or all loops 952 may have substantially the same shape. In some embodiments, different loops 952 may have different shapes.

Figure 11:
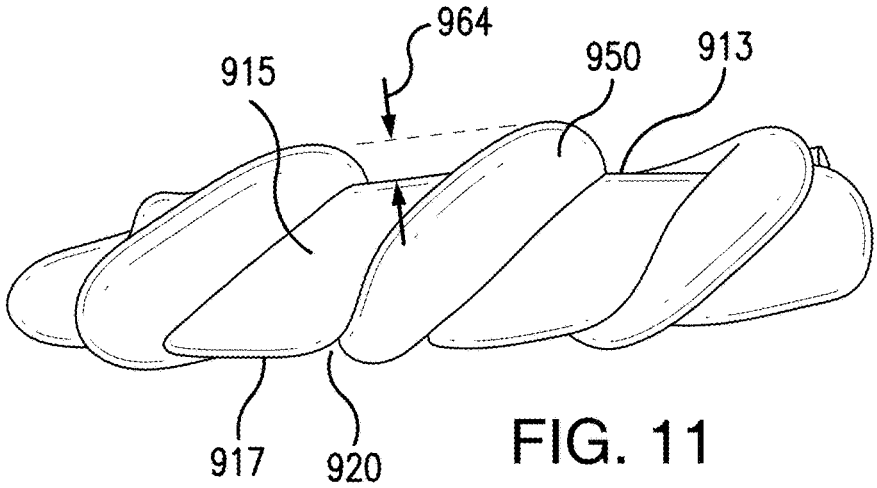
FIG. 11 is a side view of a portion of a midsole according to an embodiment.
Figure 12:
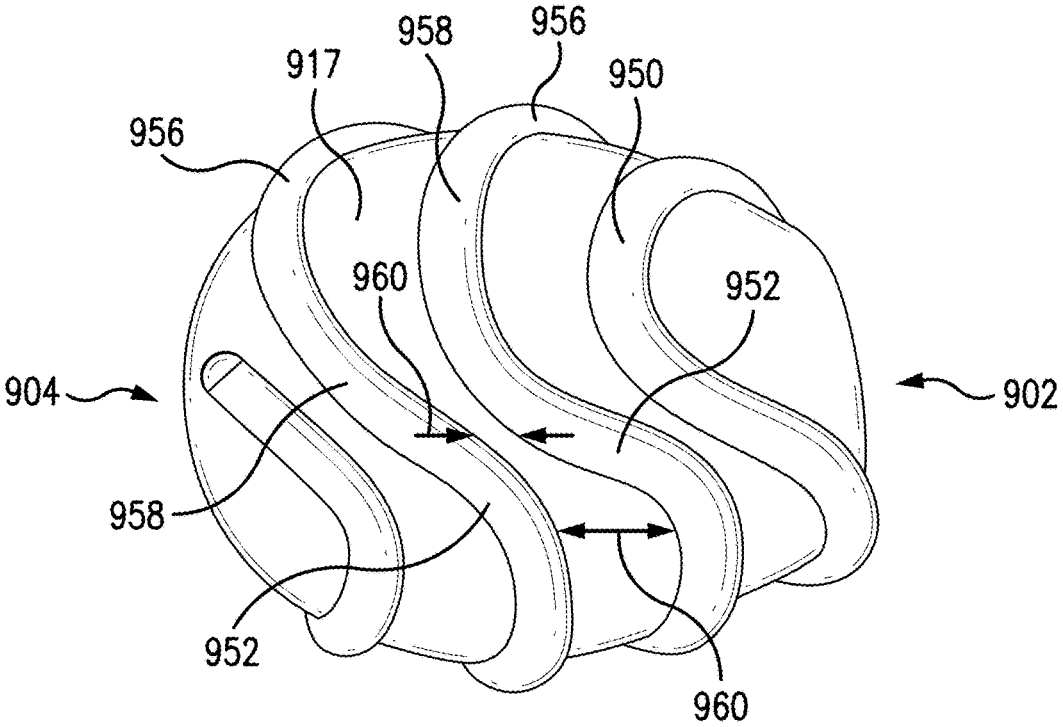
FIG. 12 is bottom view of a portion of a midsole according to an embodiment.
Figure 13:
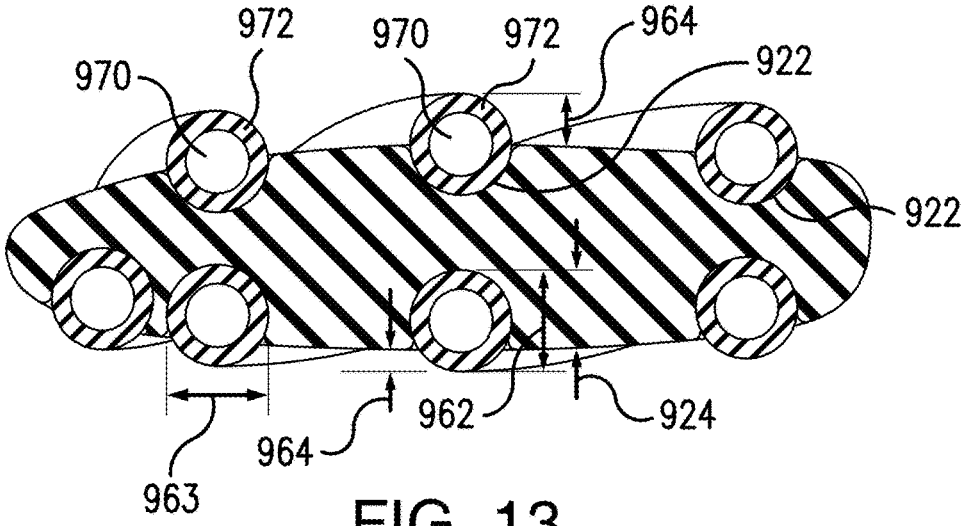
FIG. 13 is a cross-sectional view along the line 13-13' in FIG. 10.

In some embodiments, top portion 954 and/or bottom portion 958 of one or more loops 952 may protrude from top surface 913 and/or bottom surface 917, respectively, by an extension height 964 measured in vertical direction 994 (see e.g., FIGS. 11 and 13). In some embodiments, extension height 964 may be in the range of 0.5 millimeters to 10.0 millimeters. In some embodiments, extension height 964 may in the range of 1.0 millimeter to 5.0 millimeters. In some embodiments, side portions 956 of one or more loops 952 may protrude from sidewall surface 915 in transverse direction 992 in by a distance that is more than, less than, or the same as to extension height 964.

As with midsole segment 400, the protrusion of one or more portions of loops 952 from the surface(s) of core 910 may allow winding 950 to deform relative to core 910 (e.g., relative to top surface 913, bottom surface 917, and/or sidewall surface 915 of core 910) when pressure is applied to midsole segment 900 (e.g., when midsole segment 900 is deformed under the weight of an individual). Also, the protrusion of one or more portions of loops 952 from the surface(s) of core 910 may allow core 910 to deform around loops 952 (e.g., in between loops 952) when pressure is applied to midsole segment 900 (e.g., when midsole segment is deformed under the weight of an individual).

Figure 10:
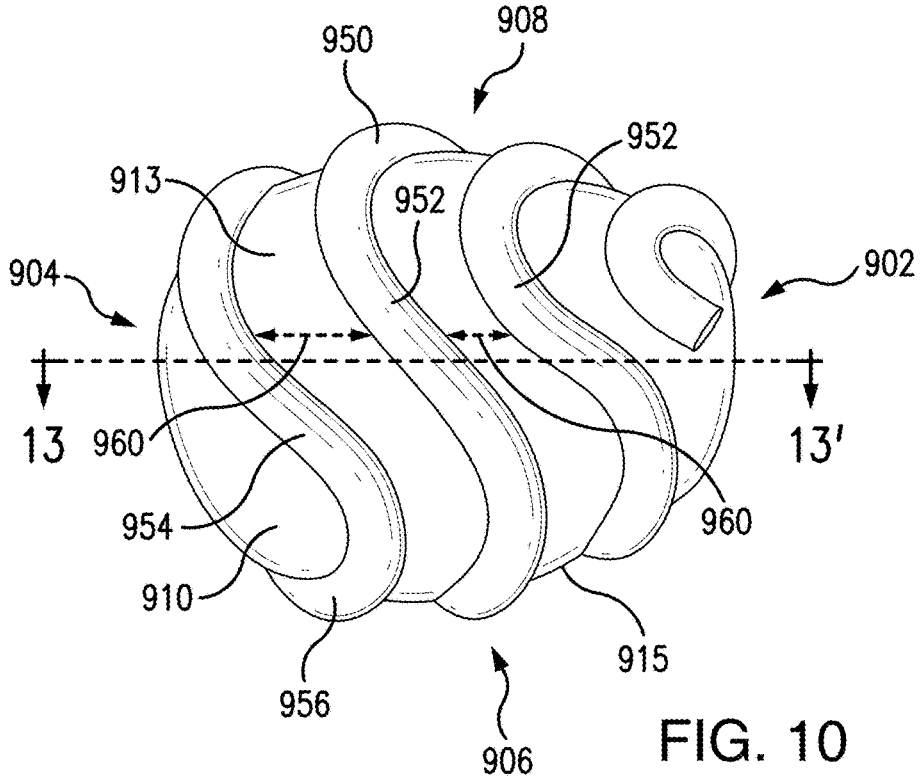
FIG. 10 is a top view of a portion of a midsole according to an embodiment.

As shown for example in FIG. 10, adjacent loops 952 may be separated by a longitudinal distance 960 measured in longitudinal direction 990. Longitudinal distance 960 between adjacent loops may define a number of loops per unit distance in longitudinal direction 990. In some embodiments, the longitudinal distance 960 between each set of adjacent loops 952 may be the same (i.e., the number of loops per unit distance may be substantially the same along the length of a midsole in longitudinal direction 990). In some embodiments, the longitudinal distance 960 between different sets of adjacent loops 952 may be different (i.e., the number of loops per unit distance may vary along the length of a midsole in longitudinal direction 990). As with midsole segment 900, changing the longitudinal distance 960 between adjacent loops 952 in longitudinal direction 990 may provide desired cushion, support, and/or ride characteristics for different areas of a midsole. In some embodiments, the number of loops per unit distance in longitudinal direction 990 may be based on a pressure map of pressures exerted on the bottom of a human foot in contact with the ground.

In some embodiments, longitudinal distance 960 between adjacent loops 952 may remain constant in transverse direction 992 between medial side 906 and lateral side 908 of a midsole. In some embodiments, longitudinal distance 960 between adjacent loops 952 may vary in transverse direction 992 on either the top and/or bottom surface of the midsole (see e.g., FIGS. 10 and 12). Varying longitudinal distance 960 in transverse direction 992 may provide desired cushion, support, and/or ride characteristics for different areas of a midsole. In some embodiments, a variation in longitudinal distance 960 between adjacent loops 952 in transverse direction 992 may be based on a pressure map of pressures exerted on the bottom of a human foot in contact with the ground.

In some embodiments, winding 950 may be wrapped around a central longitudinal axis of core 910. In some embodiments winding 950 may be wrapped around a central transverse axis of core 910. In some embodiments, adjacent loops 952 of winding 950 may partially overlap in longitudinal direction 990. In some embodiments, adjacent loops 952 of winding 950 may not overlap in longitudinal direction 990.

FIG. 13 shows a cross-sectional view of midsole segment 900 along the line 13-13' in FIG. 10. As shown in FIG. 13, core 910 may be a solid piece of material defined by top surface 913, bottom surface 917, and sidewall surface 915, respectively. In some embodiments, winding 950 may include a circular cross-sectional shape. In some embodiments, winding 950 may include a non-circular cross-sectional shape. Non-circular cross-sectional shapes include, but are not limited to, an elliptical shape, a triangular shape, a square shape, a pentagon shape, a hexagon shape, or an octagon shape. The height 962 and width 963 of winding 950 may be the same as or similar to the height 462 and width 463 of winding 450. In some embodiments, height 962 and/or width 963 of winding 950 may be constant along core 910. In some embodiments, height 962 and/or width 963 may vary at different portions of core 910. For example, height 962 and/or width 963 of winding 950 may vary along core 910 in longitudinal direction 990. In such embodiments, height 962 and/or width 963 may provide desired cushion, support, and/or ride characteristics for different areas of midsole segment 900.

In some embodiments, winding 950 (or one or more loops 952 of winding 950) may be disposed in one or more grooves 920 on core 910. Groove(s) 920 may be formed in the exterior surface of core 910 (i.e., formed in top surface 913, sidewall surface 915, and/or bottom surface 917). In some embodiments, groove 920 may be a continuous circumferential groove formed in top surface 913, sidewall surface 915, and bottom surface 917 of core 910. Groove 920 may define a plurality of adjacent recessed loops 922 disposed along core 910 in longitudinal direction 990. Adjacent loops 952 of winding 950 may be disposed in adjacent recessed loops 922 defined by groove 920.

In some embodiments, one or more loops 952 of winding 950 may be partially disposed within recessed loops 922 of groove 920. In some embodiments, one or more loops 952 of winding 950 may be fully disposed within recessed loops 922 of groove 920 (i.e., may not protrude above top surface 913 and/or below bottom surface 917 of core 910). In some embodiments, top portions 954, side portions 956, and/or bottom portions 958 of loops 952 may be coupled to top surface 913, sidewall surface 915, and/or bottom surface 917 within groove 920. In some embodiments, groove 920 may include a cross-sectional shape that conforms with the exterior shape of winding 950. In some embodiments, groove 920 may include a semi-circular cross-sectional shape. In some embodiments, groove 920 may have a depth 924 in the range of 1.0 millimeter to 10.0 millimeters. In some embodiments, groove 920 may have a depth 924 in the range of 1.25 millimeters to 3.75 millimeters. In some embodiments, groove 920 may have a depth 924 that is approximately half the height 962 of winding 950. In some embodiments, depth 924 of groove 920 may be constant along core 910. In some embodiments, depth 924 of groove 920 may vary at different portions of core 410. For example, depth 924 of groove 920 may be different on top surface 913 and bottom surface 917 (see e.g., FIG. 11). As other example, depth 924 of groove 920 may vary along core 910 in longitudinal direction 990. In such embodiments, depth 924 may provide desired cushion, support, and/or ride characteristics for different areas of midsole segment 900 by influencing the extension height 964 of winding 950 at different areas of midsole segment 900.

FIG. 13 shows a winding 950 including a co-axial composite winding having a central tube 970 surrounded by an exterior shell 972 according to some embodiments. In some embodiments, central tube 970 may comprise a different material, or of the same material but with different material properties, than exterior shell 972. In some embodiments, the material forming central tube 970 may have a higher density than the material forming exterior shell 972, or vice versa. In some embodiments, the material forming central tube 970 may have a higher stiffness than the material forming exterior shell 972, or vice versa. In some embodiments, the material forming central tube 970 may have a higher modulus than the material forming exterior shell 972, or vice versa. In some embodiments, central tube 970 may be wrapped with a fibrous material to provide desired mechanical properties for central tube 970. Central tube 970 may have a circular cross-sectional area or may have a non-circular cross-sectional area.

Figure 14:
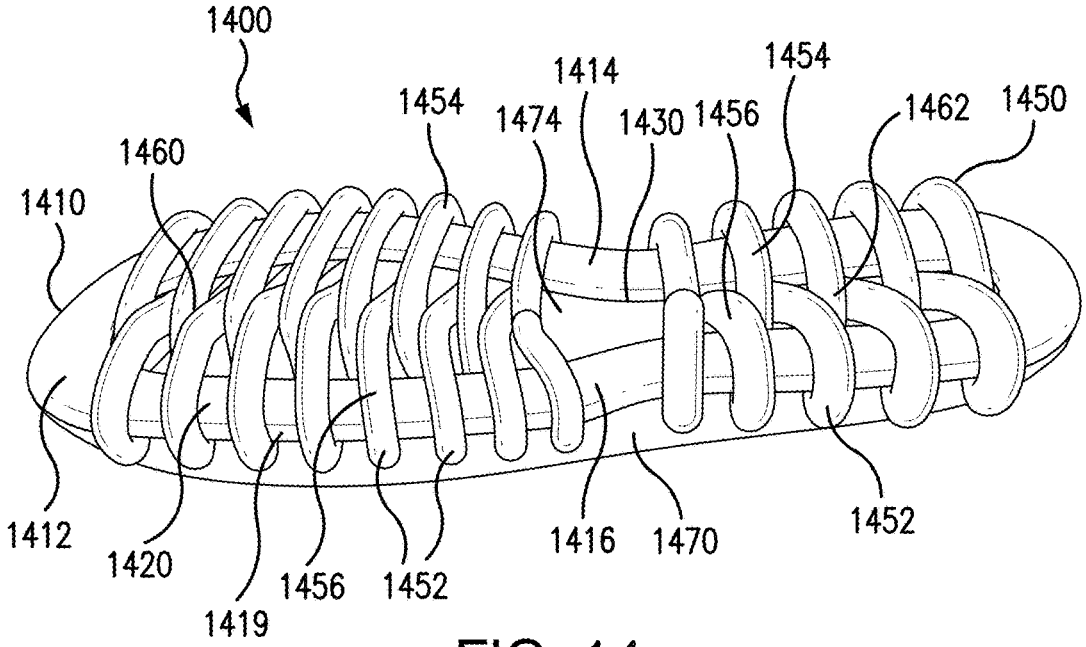
FIG. 14 is a perspective view of a midsole according to an embodiment.
Figure 15A:
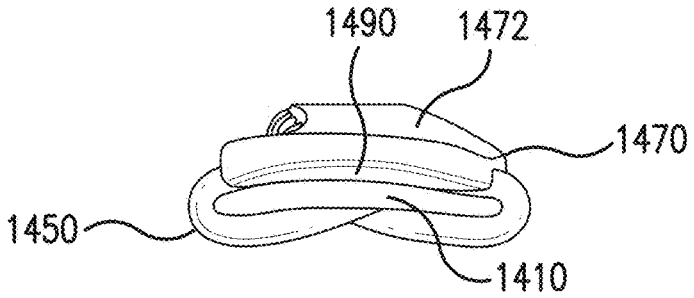
FIG. 15A is a front view of a midsole according to an embodiment.
Figure 15B:
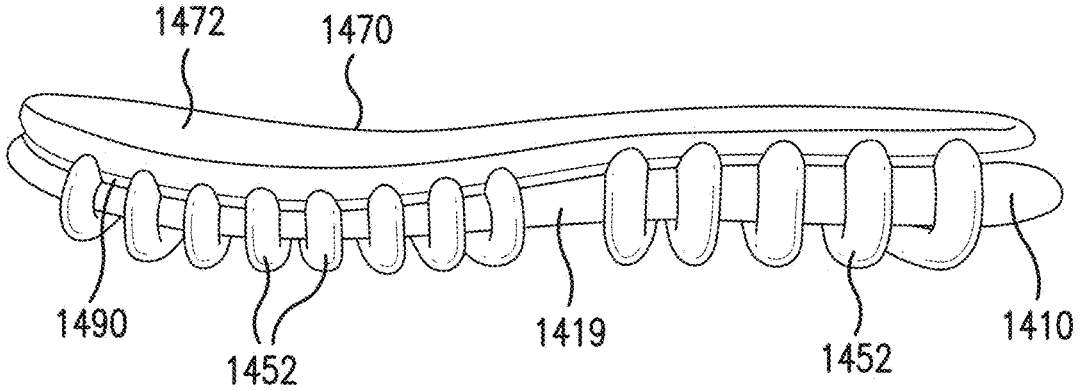
FIG. 15B is a side view of a midsole according to an embodiment.

FIGS. 14 and 15A-15B show a midsole 1400 according to an embodiment. Midsole 1400 may include a core 1410 and a winding 1450. Core 1410 may include a central opening 1430 defined by a frame 1412 having a medial portion 1414 and a lateral portion 1416. Frame 1412 may define a top surface 1418, a bottom surface 1420, and an exterior side surface 1419 of core 1410. Midsole 1400 may include a winding 1450 including a plurality of adjacent segments 1452 disposed along core 1410 in a longitudinal direction. Winding 1450 may have the same material characteristics and dimensions as discussed herein for winding 170.

Segments 1452 of winding 1450 may include a medial loop 1454 wrapped around medial portion 1414 of frame 1412 and a lateral loop 1456 wrapped around lateral portion 1416 of frame 1412. As shown for example in FIGS. 14 and 17, winding 1450 may weave in and out of central opening 1430 of core 1410 to form medial loops 1454 and lateral loops 1456. In some embodiments, segments 1452 may have a figure eight shape with a medial loop 1454 defining one loop of the figure eight and a lateral loop 1456 forming the other loop of the figure eight.

Figure 17:
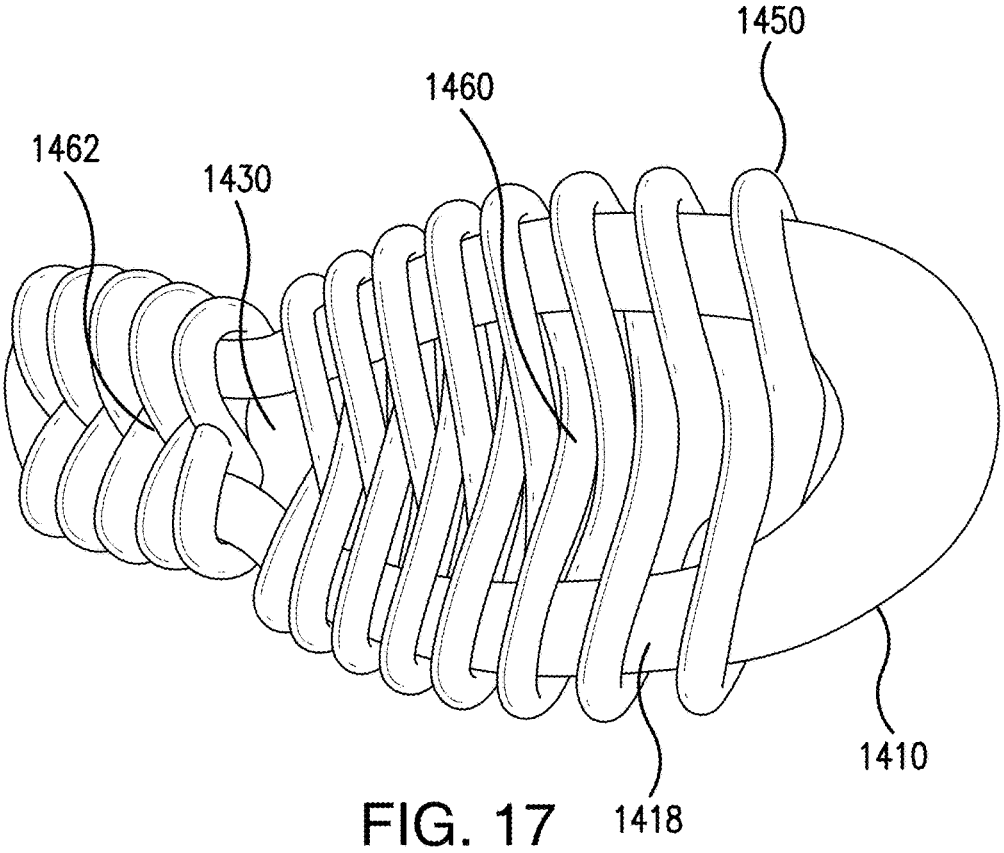
FIG. 17 is a perspective view of a winding and core for a midsole according to an embodiment.

As shown for example in FIGS. 14 and 17, medial loops 1454 and lateral loops 1456 may include a portion extending across top surface 1418 of core 1410 and a portion extending across bottom surface 1420 of core 1410. In some embodiments, all, or some of, medial loops 1454 and lateral loops 1456 may include a portion extending across and protruding from top surface 1418 of core 1410. When midsole 1400 is coupled to an upper, medial loops 1454 and lateral loops 1456 protruding from top surface 1418 of core 1410 may extend above top surface 1418 towards the upper. In some embodiments, all, or some of, medial loops 1454 and lateral loops 1456 may include a portion extending across and protruding from bottom surface 1420 of core 1410. Medial loops 1454 and lateral loops 1456 may also wrap around and protrude from exterior side surface 1419 of core 1410.

In some embodiments, winding 1450 may be attached to core 1410 via an adhesive disposed between winding 1450 and core 1410. In some embodiments, winding 1450 may be in direct contact with top surface 1418 and/or bottom surface 1420 of core 1410. In some embodiments, winding 1450 may be attached to core 1410 such that relative movement between winding 1450 and core 1410 is prevented. In some embodiments, winding 1450 may only be attached to core 1410 at certain locations, or not attached to core 1410 at all, so that winding 1450 and core 1410 may move relative to each other. In some embodiments, winding 1450 may only be attached to the sidewall surfaces of core 1410 to allow winding 1450 to move relative to core 1410. In some embodiments, midsole 1400 may include connectors disposed between and coupling adjacent segments 1452 together. In some embodiments, the connectors may reduce abrasion between winding 1450 and core 1410 by limiting the amount of relative movement between winding 1450 and core 1410. In some embodiments, the connectors may be rubber connectors.

In some embodiments, when winding 1450 and core 1410 are assembled together, they may be fused together using, for example, a dip or spray coating technique to create a cohesive bond between winding 1450 and core 1410. This fusion may be accelerated with thermal sources such as convection or radiant heat, various wave frequency treatments such as microwave or radio-frequency (RF) treatments, and various light treatments such infrared (IR) and ultraviolet (UV) light treatments.

Figure 16:
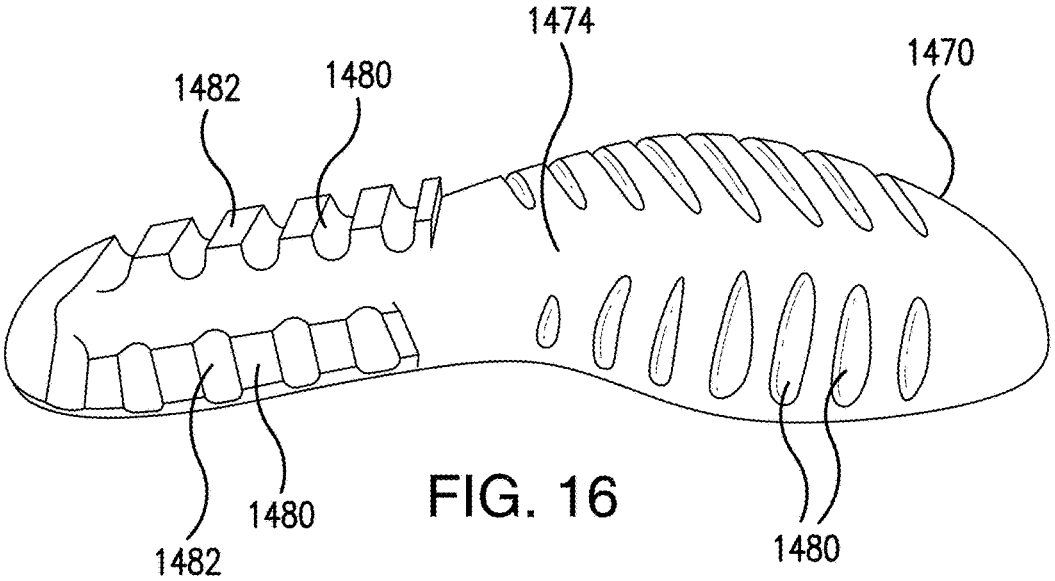
FIG. 16 is a perspective view of a footplate according to an embodiment.

In some embodiments, midsole 1400 may include a footplate 1470. Footplate 1470 may be the same as or similar to footplate 122. Footplate 1470 includes a top surface 1472 disposed opposite a bottom surface 1474. Top surface 1472 may be configured to couple with an upper. In some embodiments, core 1410 and/or winding 1450 may be coupled to bottom surface 1474 of footplate 1470. In some embodiments, as shown for example in FIG. 16, footplate 1470 may include recesses 1480 on bottom surface 1474. In some embodiments, recesses 1480 may be defined by projections 1482 protruding from bottom surface 1474. Recesses 1480 may be configured (i.e., sized and shaped) to receive all or a part of the portion of a medial loops 1454 or lateral loops 1456 protruding from top surface 1418 of core 1410. Bottom surface 1474 may be coupled to core 1410 and/or winding 1450 via, for example, an adhesive (e.g., liquid cement).

In some embodiments, the depth of recesses 1480 may be less than the height of the portion of medial loops 1454 or lateral loops 1456 protruding from top surface 1418 of core 1410. In such embodiments, a space 1490 may be created between footplate 1470 and core 1410. Space 1490 may serve to give the visual impression that footplate 1470 is floating above core 1410. In some embodiments, space 1490 may serve to allow deformation of winding segments 1452 between footplate 1470 and core 1410 to facilitate desired cushioning, support, and/or ride characteristics for an article of footwear.

In some embodiments, winding 1450 may be a single continuous piece wrapped from a forefoot portion (or heel portion) of midsole 1400 to a heel portion (or forefoot portion) of midsole 1400. In some embodiments, similar to winding 170, winding 1450 may include a forefoot winding 1460 and a rearfoot winding 1462. In some embodiments, forefoot winding 1460 may be a single continuous piece wrapped from a forefoot portion of midsole 1400 to a midfoot portion of midsole 1400. In some embodiments, rearfoot winding 1462 may be a single continuous piece wrapped from a heel portion of midsole 1400 to a midfoot portion of midsole 1400. In some embodiments, midsole 1400 may comprise winding 1450 without core 1410.

Figure 18:
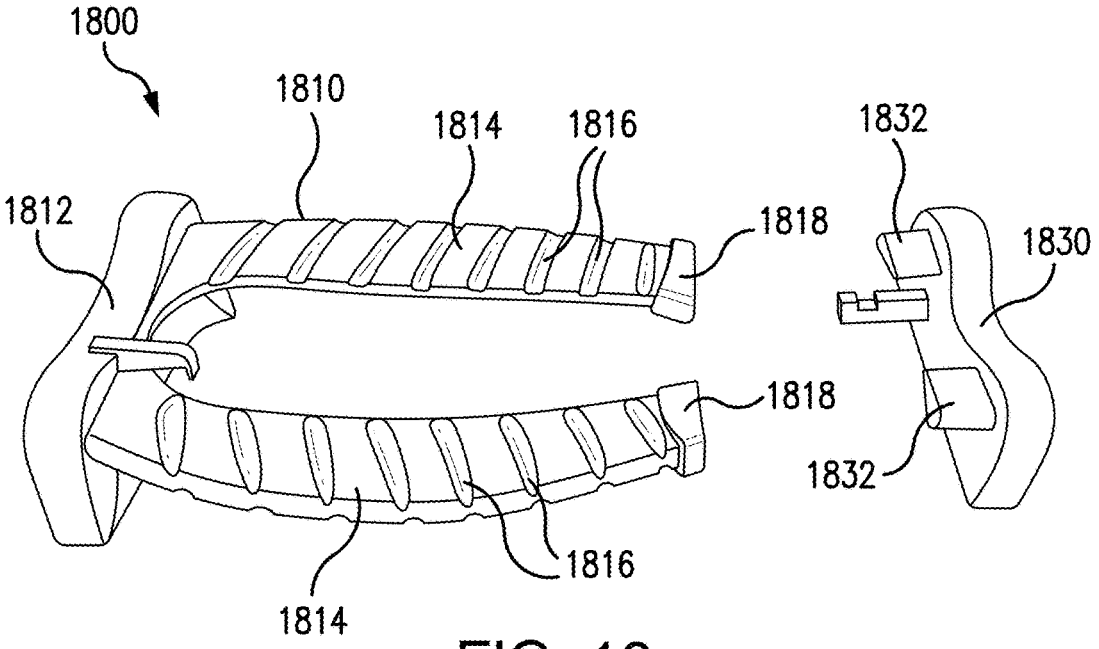
FIG. 18 is a perspective view of a winding tool according to an embodiment.

FIG. 18 shows a winding tool 1800 for forming forefoot winding 1460 according to an embodiment. Tool 1800 may include a horseshoe 1810 having two arms 1814 coupled to and extending from a base 1812. In some embodiments, arms 1814 may include a plurality of guides 1816. In some embodiments, guides 1816 may be grooves. In some embodiments, tool 1800 may include an end cap 1830.

In operation, forefoot winding 1460 may be formed by wrapping a tube or rod of material (e.g., extruded material) around arms 1814 in a figure eight fashion to form medial loops and lateral loops. In embodiments including guides

1816, guides 1816 may serve to provide a frame of reference for the spacing and configuration of winding 1450. In some embodiments, end cap 1830 may be coupled to free ends 1818 of arms to during wrapping of the tube or rod. In such embodiments, end cap 1830 may include releasable couplings 1832 configured to couple with free ends 1818 of arms 1814. End cap 1830 may be removed from horseshoe 1810 so that horseshoe 1810 may be removed from forefoot winding 1460 after wrapping.

In some embodiments, heat may be applied during or after wrapping of forefoot winding 1460. In such embodiments, the heat may serve to chemically and/or physically set forefoot winding 1460 in its desired shape. In some embodiments, the thermally set forefoot winding 1460 may be taken off horseshoe 1810 and wrapped around core 1410. Then footplate 1470 may be coupled to forefoot winding 1460 and/or core 1410. In some embodiments, forefoot winding 1460 may be coupled to footplate 1470 and midsole 1400 may not include core 1410. Tools similar to winding tool 1800 may be used to form rearfoot winding 1462 or a continuous winding 1450 configured to extend from a forefoot portion (or heel portion) of midsole 1400 to a heel portion (or forefoot portion) of midsole 1400. In some embodiments, winding 1450, or portion thereof (e.g., forefoot winding 1460 or rearfoot winding 1462) may be wrapped directly around core 1410 rather than being first wrapped around a winding tool.

Figure 19:
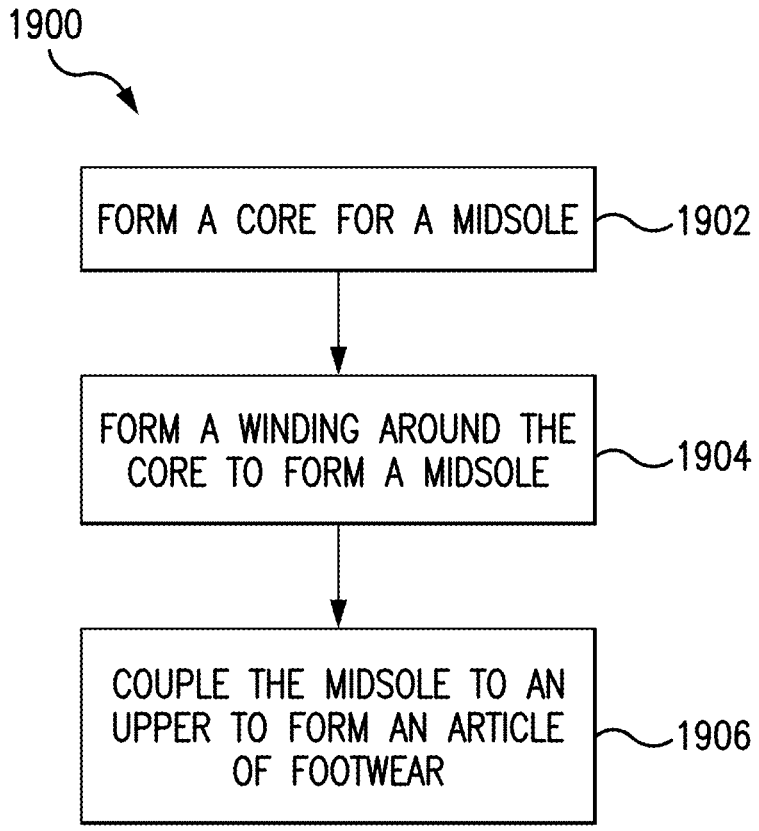
FIG. 19 is a flowchart of an exemplary method of manufacturing a midsole and article of footwear according to an embodiment.

FIG. 19 shows an exemplary method of making a midsole and an article of footwear according to an embodiment. The order of the processes discussed below is exemplary and may be rearranged depending on a number of factors, for example, but not limited to, optimization of the assembly process and the layout (e.g., the location of equipment and/or process flow) of a production floor.

In step 1902 a core (e.g., core 150) for a midsole may be formed. In some embodiments, forming the core includes forming a bladder filled with a fluid, such as air. In some embodiments, forming the core includes blow molding a bladder filled with a fluid, such as air. In some embodiments, the blow molding of a bladder may include pressurizing the air within the bladder relative to ambient air pressure. In some embodiments, the air within the bladder may be pressured to a psi in the range of 0.1 psi to 1.0 psi above ambient air pressure when no external forces are acting on the bladder. In some embodiments, forming the core includes molding the core (e.g. via injection molding compression molding, and rotational molding).

In step 1904, a winding (e.g., winding 170) may be formed around a core to form a plurality of adjacent loops (e.g., loops 172) wrapped around the core. In some embodiments, forming the winding may include molding the winding and wrapping the winding around the core. In some embodiments, step 1904 may be performed concurrently with step 1902 (e.g., the winding may be integrally molded with a core in step 1902). In some embodiments, forming the winding may include extruding the winding and wrapping the winding around a core. In some embodiments, forming the winding may include extruding the winding directly onto the core. In some embodiments, the winding may be extruded directly onto the core and allowed to cure after being disposed on the core. After forming the midsole in step 1904, the midsole may be coupled to an upper (e.g., upper 120) to form an article of footwear in step 1906.

Some embodiments may include an article of footwear including an upper and a midsole coupled to the upper, the midsole including a core having a top surface coupled to the upper and a bottom surface disposed opposite the top surface and a winding wrapped around the core to form a plurality of loops, each loop of the winding having a portion extending across and protruding from the top surface of the core and a portion extending across and protruding from the bottom surface of the core.

In any of the various embodiments discussed herein, the winding may be a single continuous piece wrapped to form a plurality of loops. In any of the various embodiments discussed herein, the winding may be a single continuous piece wrapped from a heel portion of an article of footwear to a midfoot portion of an article of footwear. In any of the various embodiments discussed herein, the winding may be a single continuous piece wrapped from a heel portion of an article of footwear to a forefoot portion of an article of footwear.

In any of the various embodiment discussed herein, the core of a midsole may include a bladder. In any of the various embodiments discussed herein, the bladder may be filled with air. In any of the various embodiments discussed herein, the bladder may be filled with air having a pressure in the range of 0.1 psi to 1.0 psi above ambient pressure when no external forces are acting on the bladder. In any of the various embodiments discussed herein, the core of a midsole may include a polymeric foam.

In any of the various embodiments discussed herein, the core of a midsole may include one or more grooves formed in the top surface of the core and the bottom surface of the core for receiving loops of a winding wrapped around the core.

In any of the various embodiments discussed herein, an article of footwear may include a footplate having recesses defined by a plurality of projections and each recess may be configured to receive a portion of a loop extending from the top surface of a core. In any of the various embodiments discussed herein, the height of the projections may be greater than the height of the loops extending from the top surface of the core. In any of the various embodiments discussed herein, a core may be coupled to the footplate. In any of the various embodiments discussed herein, a midsole may be coupled to the projections of the footplate.

In any of the various embodiments discussed herein, the core of a midsole may include a forefoot core coupled to a rearfoot core. In any of the various embodiments discussed herein, a winding may be wrapped around the forefoot core at least twice and wrapped around the rearfoot core at least twice.

In any of the various embodiments discussed herein, the loops of a winding may not overlap in a longitudinal direction between a forefoot end of a midsole and a heel end of a midsole.

In any of the various embodiments discussed herein, a winding may be coupled to the top surface and the bottom surface of a core. In any of the various embodiments discussed herein, a winding may be in direct contact with the top surface and the bottom surface of a core.

Some embodiments may include an article of footwear including an upper and a midsole coupled to the upper, the midsole including a forefoot end disposed opposite a heel end in a longitudinal direction, a core having an exterior surface defined by a top surface, a bottom surface disposed opposite the top surface, and a perimeter surface extending between the top surface and the bottom surface, and a winding wrapped around the exterior surface of the core multiple times to form a plurality of adjacent loops disposed along the core in the longitudinal direction.

In any of the various embodiments discussed herein, one or more loops of a winding may include a portion extending straight across the top surface of a core between a medial side of the core and a lateral side of the core and a portion extending straight across a bottom surface of the core between the medial side of the core and the lateral side of the core. In any of the various embodiments discussed herein, one or more loops of a winding may include a portion extending straight across the top surface of a core in a diagonal direction between a medial side of the core and a lateral side of the core and a portion extending straight across a bottom surface of the core in a diagonal direction between the medial side of the core and the lateral side of the core. In any of the various embodiments discussed herein, one or more loops of a winding may include a wavy portion extending across the top surface of a core from a medial side of the core to a lateral side of the core and a wavy portion extending across the bottom surface of the core from the medial side of the core to the lateral side of the core.

In any of the various embodiments discussed herein, each loop of a winding may have substantially the same shape. In any of the various embodiments discussed herein, one or more loops of a winding may have different shapes.

In any of the various embodiments discussed herein, a winding may include a number of loops per unit distance in a longitudinal direction and the number of loops per unit distance in the longitudinal direction may be substantially the same along the length of a midsole in the longitudinal direction. In any of the various embodiments discussed herein, a winding may include a number of loops per unit distance in a longitudinal direction and the number of loops per unit distance in the longitudinal direction may vary along the length of a midsole in the longitudinal direction. In any of the various embodiments discussed herein, the number of loops per unit distance in a longitudinal direction may be based on a pressure map of pressures exerted on the bottom of a human foot in contact with the ground. In any of the various embodiments discussed herein, the number of loops per unit distance in a longitudinal direction in a heel portion of a midsole may be smaller than the number of loops per unit distance in the longitudinal direction in a midfoot portion of the midsole.

In any of the various embodiments discussed herein, a winding may include ethylene-vinyl acetate foam. In any of the various embodiments discussed herein, a winding may include a central tube surrounded by an exterior shell. In any of the various embodiments discussed herein, the central tube may be composed of a first material and the exterior shell may be composed of a second material. In any of the various embodiments discussed herein, the first material may have a higher density than the second material. In any of the various embodiments discussed herein, the first material may have a higher stiffness than the second material.

Some embodiments may include a midsole for an article of footwear, the midsole including a core including a forefoot end disposed opposite a heel end in a longitudinal direction and a continuous circumferential groove formed in an exterior surface of the core and defining a plurality of adjacent recessed loops disposed along the core in the longitudinal direction, and a continuous elongate tube disposed in the plurality of adjacent recessed loops defined by the circumferential groove.

In any of the various embodiments discussed herein, the core of a midsole may include a forefoot core coupled to a rearfoot core. In any of the various embodiments discussed herein, the core of a midsole may include a plurality of continuous circumferential grooves defining a plurality of adjacent recessed loops and at least one continuous circumferential groove may be formed in an exterior surface of the forefoot core and at least one continuous circumferential groove may be formed in an exterior surface of the rearfoot core. In any of the various embodiments discussed herein, the core of a midsole may include a plurality of continuous elongate tubes and at least one continuous elongate tube may be disposed in a circumferential groove formed in the forefoot core and at least one continuous elongate tube may be disposed in a circumferential groove formed in the rearfoot core.

In any of the various embodiments discussed herein, the core of a midsole may include an air-filled bladder. In any of the various embodiments discussed herein, the continuous elongate tube of a winding may include a polymeric material. In any of the various embodiments discussed herein, the continuous elongate tube of a winding may include a polymeric foam material. In any of the various embodiments discussed herein, the continuous elongate tube of a winding may protrude from a continuous circumferential groove formed in a core of a midsole.

In any of the various embodiments discussed herein, the continuous elongate tube of a winding may be a non-hollow tube. In any of the various embodiments discussed herein, the continuous elongate tube of a winding may be a hollow tube. In any of the various embodiments discussed herein, the continuous elongate tube of a winding may be a composite tube.

Some embodiments discussed herein include a method of making a midsole for an article of footwear, the method including forming a winding around a core to form a plurality of adjacent loops wrapped around the core, each loop of the winding including a portion extending across and protruding from a top surface of the core and a portion extending across and protruding from a bottom surface of the core.

In any of the various embodiments discussed herein, forming a winding may include molding the winding and wrapping the winding around a core. In any of the various embodiments discussed herein, forming a winding may include extruding the winding and wrapping the winding around a core. In any of the various embodiments discussed herein, forming a winding may include extruding the winding onto a core to form a plurality of adjacent loops.

In any of the various embodiments discussed herein, the method of making a midsole may include forming a core. In any of the various embodiments discussed herein, forming a core may include blow molding a bladder filled with air. In any of the various embodiments discussed herein, blow molding a core may pressurize the air within a bladder to a pressure in the range of 0.1 psi to 1.0 psi above ambient air pressure.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. An article of footwear comprising:

an upper comprising a bottom surface comprising recesses extending from a lateral side to a medial side of the upper and defined by a plurality of projections; and a midsole coupled to the upper, the midsole comprising:

a core having a top side comprising a top surface coupled to the upper, a bottom side comprising a bottom surface disposed opposite the top surface, a toe side, a heel side, a lateral side, and a medial side, and a winding wrapped around the core to form a plurality of loops, wherein each loop of the winding comprises:

a portion extending from the lateral side to the medial side of the core and protruding from the top surface of the core, and a portion extending from the lateral side to the medial side of the core and protruding from the bottom surface of the core, wherein the portion of each loop protruding from the top surface of the core is disposed in one of the recesses on the bottom surface of the upper.

2. The article of footwear of claim 1, wherein the winding is a single continuous piece wrapped to form the plurality of loops.

3. The article of footwear of claim 1 wherein the winding is a single continuous piece wrapped from a heel portion of the article of footwear to a midfoot portion of the article of footwear.

4. The article of footwear of claim 1, wherein the winding is a single continuous piece wrapped from a heel portion of the article of footwear to a forefoot portion of the article of footwear.

5. The article of footwear of claim 1, wherein the core comprises a bladder.

6. The article of footwear of claim 1, wherein the core comprises a polymeric foam.

7. The article of footwear of claim 1, wherein the core comprises one or more grooves formed in the top surface and the bottom surface for receiving loops of the winding wrapped around the core.

8. The article of footwear of claim 1, comprising a footplate defining the bottom surface of the upper.

9. The article of footwear of claim 1, wherein a height of the projections is greater than a height of the loops protruding from the top surface of the core.

10. The article of footwear of claim 8, wherein the core is coupled to the footplate.

11. The article of footwear of claim 1, wherein the core comprises a forefoot core coupled to a rearfoot core.

12. The article of footwear of claim 11, wherein the winding is wrapped around the forefoot core at least twice and wherein the winding is wrapped around the rearfoot core at least twice.

13. The article of footwear of claim 1, wherein the winding is coupled to the top surface and the bottom surface of the core.

14. A midsole for an article of footwear, the midsole comprising:

a core comprising a forefoot end disposed opposite a heel end in a longitudinal direction and a continuous circumferential groove formed in an exterior surface of the core, the continuous circumferential groove defining a plurality of adjacent recessed loops disposed along the core in the longitudinal direction;

a continuous elongate tube comprising a plurality of loops disposed in the plurality of adjacent recessed loops defined by the circumferential groove, the continuous elongate tube comprising at least one of: a polymeric foam or an elastomer; and a plurality of separate traction members disposed on the plurality of loops of the continuous elongate tube, wherein each separate traction member is disposed on only one of the plurality of loops.

15. The midsole of claim 14, wherein the core comprises a forefoot core coupled to a rearfoot core.

16. The midsole of claim 15, wherein the core comprises a plurality of continuous circumferential grooves defining a plurality of adjacent recessed loops, and wherein at least one continuous circumferential groove is formed in an exterior surface of the forefoot core and at least one continuous circumferential groove is formed in an exterior surface of the rearfoot core.

17. The midsole of claim 16, wherein the midsole comprises a plurality of continuous elongate tubes, and wherein at least one continuous elongate tube is disposed in the circumferential groove formed in the forefoot core and at least one continuous elongate tube is disposed in the circumferential groove formed in the rearfoot core.

18. The midsole of claim 14, wherein the continuous elongate tube comprises a non-hollow tube.

19. An article of footwear comprising:

an upper; and a midsole coupled to the upper, the midsole comprising a core and a winding wrapped around the core, the winding comprising:

a first winding comprising a plurality of loops, wherein each loop of the first winding comprises a portion extending across and protruding from a top surface of the core and a portion extending across and protruding from a bottom surface of the core, and a second winding comprising a plurality loops, wherein each loop of the second winding comprises a portion extending across and protruding from the top surface of the core and a portion extending across and protruding from the bottom surface of the core, wherein the first winding and the second winding comprise at least one different winding characteristic selected from the group consisting of: a material of the first and second windings, and a diameter of the first and second windings, wherein the loops of the first winding and the loops of the second winding do not overlap, and wherein the first winding is wrapped around a forefoot portion of the core and wherein the second winding is wrapped around a rearfoot portion of the core.

20. The article of footwear of claim 19, wherein the first winding and the second winding are portions of a single continuous winding.

21. The article of footwear of claim 19, wherein at least one of the first winding and the second winding comprise a polymeric foam or an elastomer.

22. The article of footwear of claim 19, wherein the first winding and the second winding provide different degrees of cushioning for the forefoot portion of the core and the rearfoot portion of the core.

23. The article of footwear of claim 19, wherein a winding characteristic of at least one of the first winding and the second winding is based on data from a pressure map of pressures exerted on the bottom of a human foot in contact with the ground.

* * * * *